US010293618B2

(12) United States Patent
Kobayashi et al.

(10) Patent No.: US 10,293,618 B2
(45) Date of Patent: May 21, 2019

(54) LIQUID CONSUMPTION APPARATUS HAVING CARTRIDGE, CARTRIDGE ATTACHMENT SECTION PROVIDED WITH TANK, AND CONSUMING DEVICE

(71) Applicant: BROTHER KOGYO KABUSHIKI KAISHA, Nagoya-shi, Aichi-ken (JP)

(72) Inventors: Akihito Kobayashi, Konan (JP); Akinari Ishibe, Okazaki (JP); Yuma Tanabe, Nagoya (JP); Masahiro Hayashi, Nagoya (JP); Masatake Sato, Nagoya (JP); Yoshinori Osakabe, Seto (JP); Hiroaki Takahashi, Nagoya (JP)

(73) Assignee: BROTHER KOGYO KABUSHIKI KAISHA, Nagoya-shi, Aichi-Ken (JP)

( * ) Notice: Subject to any disclaimer, the term of this patent is extended or adjusted under 35 U.S.C. 154(b) by 13 days.

(21) Appl. No.: 15/663,872

(22) Filed: Jul. 31, 2017

(65) Prior Publication Data

US 2018/0178539 A1 Jun. 28, 2018

(30) Foreign Application Priority Data

Dec. 28, 2016 (JP) ..... 2016-256033
Dec. 28, 2016 (JP) ..... 2016-256034

(51) Int. Cl.
*B41J 2/175* (2006.01)
*B41J 2/19* (2006.01)
*B41J 29/13* (2006.01)

(52) U.S. Cl.
CPC ..... *B41J 2/19* (2013.01); *B41J 2/1752* (2013.01); *B41J 2/1753* (2013.01);
(Continued)

(58) Field of Classification Search
CPC .... B41J 2/175; B41J 2/17503; B41J 2/17506; B41J 2/17513; B41J 2/1752;
(Continued)

(56) References Cited

U.S. PATENT DOCUMENTS 5,270,739 A 12/1993 Kitani et al.
2005/0041076 A1 2/2005 Katayama
(Continued)

FOREIGN PATENT DOCUMENTS

EP 1 053 874 A2 11/2000
EP 1053874 A2 * 11/2000 ..... B41J 2/17503
(Continued)

OTHER PUBLICATIONS

Extended European Search Report from European Patent Application No. 17184050.7, dated Feb. 1, 2018.
(Continued)

*Primary Examiner* — Geoffrey S Mruk
*Assistant Examiner* — Scott A Richmond
(74) *Attorney, Agent, or Firm* — Merchant & Gould P.C.

(57) ABSTRACT

In a state where a supply portion of a cartridge is connected to a connecting portion of a cartridge attachment section, a first base part and a first protruding part of the cartridge and a second base part and a second protruding part of the cartridge attachment section have the following positional relationship:

as viewed in the horizontal direction, the first base part is overlapped with both of the second base part and second protruding part, the first protruding part is overlapped with the second base part, but is not overlapped with the second protruding part; and as viewed in the vertical direction, the first base part is not overlapped with the second base part, and is not overlapped with the second protruding part, and the first
(Continued)

protruding part is overlapped with the second protruding part, but is not overlapped with the second base part.

18 Claims, 11 Drawing Sheets

(52) U.S. Cl.
CPC ..... *B41J 2/17513* (2013.01); *B41J 2/17523* (2013.01); *B41J 2/17546* (2013.01); *B41J 2/17553* (2013.01); *B41J 2/17556* (2013.01); *B41J 2/17566* (2013.01); *B41J 29/13* (2013.01); *B41J 2002/17576* (2013.01)

(58) Field of Classification Search
CPC ..... B41J 2/17523; B41J 2/17553; B41J 2/17556; B41J 2/17566
See application file for complete search history.

(56) References Cited

U.S. PATENT DOCUMENTS

| | | | | |
|---|---|---|---|---|
| 2006/0250425 | A1 | 11/2006 | Nambudiri et al. | |
| 2009/0201351 | A1* | 8/2009 | Shimizu | B41J 2/17509 347/87 |
| 2011/0310195 | A1 | 12/2011 | Nakamura | |

FOREIGN PATENT DOCUMENTS

| | | | |
|---|---|---|---|
| JP | 2005-161637 | | 6/2005 |
| JP | 2008-230162 | A | 10/2008 |
| JP | 2008-238792 | A | 10/2008 |
| JP | 2010-6074 | | 1/2010 |

OTHER PUBLICATIONS

International Search Report and Written Opinion issued in related application PCT/JP2017/027663, dated Oct. 10, 2017.

* cited by examiner

LIQUID CONSUMPTION APPARATUS HAVING CARTRIDGE, CARTRIDGE ATTACHMENT SECTION PROVIDED WITH TANK, AND CONSUMING DEVICE

CROSS REFERENCE TO RELATED APPLICATION

This application claims priorities from Japanese Patent Application Nos. 2016-256033 and 2016-256034, both of which were filed Dec. 28, 2016. The entire content of the priority application is incorporated herein by reference.

TECHNICAL FIELD

The present disclosure relates to a liquid consumption apparatus that consumes liquid stored in a cartridge.

BACKGROUND

For example, each of Japanese Patent Application Publication Nos. 2008-238792 and 2008-230162 discloses an inkjet recording apparatus including a cartridge that stores ink, an attachment section to which the cartridge is detachably attached, a subsidiary tank that stores ink supplied from the cartridge attached to the attachment section due to a water head difference, and a recording section that records an image on a recording medium by ejecting ink stored in the subsidiary tank.

SUMMARY

In the inkjet recording apparatuses described in the above-described publications, image recording can be continuously performed by using ink stored in the subsidiary tank during a period from when ink stored in the cartridge runs out (hereinafter, referred to as "cartridge empty") to when the cartridge is replaced with a new one. However, if the capacity of the subsidiary tank is increased in order to extend the period during which image recording can be performed after cartridge empty, the amount of ink that is to be transferred from a cartridge to the subsidiary tank when the cartridge is newly attached to the attachment section will also increase.

That is, if the capacity of the subsidiary tank is simply increased, it will take a longer period of time from when the cartridge is newly attached to the attachment section and until transfer of the ink from the cartridge to the subsidiary tank is completed, that is, until liquid surfaces of ink in the subsidiary tank and in the cartridge become equal to each other in their heights. Users will have such impression that a large amount of ink from a cartridge is consumed when the cartridge is newly attached to the attachment section.

It is desirable that a plurality of types of cartridges having different ink storage amounts are selectable in accordance with recent diversification of utilization of the inkjet recording apparatus. Further, the different types of cartridges desirably have different outer shapes so as to allow users to easily recognize differences in the amount of stored ink.

However, there exist components that should be disposed at the same position among all cartridges, such as an ink supply portion for supplying ink and an engaged part configured to be engaged with the attachment section to lock the cartridge relative to the attachment section. Thus, the outer shape of the cartridge cannot freely be changed in accordance with a change in the volume inside the cartridge.

For example, in order to enlarge the size of the outer shape of the cartridge described in each of the above-described publications, the length of the cartridge in the insertion direction with respect to the attachment section needs to be increased. However, in order to attach the cartridge elongated in the insertion direction to the attachment section, then the size of the inkjet recording apparatus in the depth direction needs to be increased.

In view of the above-described problems, an object of the disclosure is to provide a liquid consumption apparatus capable of continuously consuming liquid even after the cartridge has become empty and also capable of suppressing the amount of liquid to flow out from the cartridge at the time of attachment.

Another object of the disclosure is to provide a liquid consumption apparatus capable of being attached with a plurality of types of cartridges having different ink storage amounts, without involving an increase in the size of the liquid consumption apparatus.

According to one aspect, a liquid consumption apparatus includes: a cartridge; a cartridge attachment section; and a consuming device. The cartridge includes: a first storage chamber; a first air communication portion; and a supply portion. The first storage chamber stores a liquid. The first air communication portion allows the first storage chamber to communicate with an atmosphere. The supply portion is configured to supply the liquid stored in the first storage chamber. The cartridge attachment section includes: a connecting portion; and a tank. The connecting portion is configured to be connected with and disconnected from the supply portion. The tank includes: a liquid flow-in port; a second storage chamber; a liquid flow-out port; and a second air communication portion. The liquid flow-in port allows the liquid, which has been supplied from the first storage chamber through the supply portion and the connecting portion connected with the supply portion, to pass though the liquid flow-in port. The second storage chamber is configured to store the liquid that has flown through the liquid flow-in port. The liquid flow-out port is disposed at a position below the liquid flow-in port and configured to allow the liquid stored in the second storage chamber to flow out of the second storage chamber. The second air communication portion allows the second storage chamber to communicate with the atmosphere. The consuming device is configured to consume the liquid flown from the second storage chamber through the liquid flow-out port. The cartridge further includes a wall defining a first base part and a first protruding part. The first storage chamber extends over insides of both of the first base part and the first protruding part. The tank further includes a wall defining a second base part and a second protruding part. The second storage chamber extends over insides of both of the second base part and the second protruding part. In a used posture of the liquid consumption apparatus, the first protruding part protrudes in a horizontal direction from an upper portion of the first base part that is defined in a vertical direction, and the second protruding part protrudes in the horizontal direction from a lower portion of the second base part that is defined in the vertical direction. In a state where the supply portion is connected to the connecting portion, the first base part and the first protruding part have the following positional relationship with the second base part and the second protruding part:

as viewed in the horizontal direction, the first base part is overlapped with both of the second base part and the second protruding part;

as viewed in the vertical direction, the first base part is not overlapped with the second base part, and is not overlapped with the second protruding part;

as viewed in the horizontal direction, the first protruding part is overlapped with the second base part, but is not overlapped with the second protruding part; and as viewed in the vertical direction, the first protruding part is overlapped with the second protruding part, but is not overlapped with the second base part.

According to another aspect, a liquid consumption system includes: a cartridge; and a liquid consumption apparatus. The cartridge includes: a first storage chamber; a first air communication portion; and a supply portion. The first storage chamber stores a liquid. The first air communication portion allows the first storage chamber to communicate with an atmosphere. The supply portion is configured to supply the liquid stored in the first storage chamber. The liquid consumption apparatus is configured to consume the liquid supplied from the supply portion of the cartridge. The liquid consumption apparatus includes: a cartridge attachment section; and a consuming section. The cartridge attachment section includes: a connecting portion; and a tank. The connecting portion is configured to be connected with and disconnected from the supply portion. The tank includes: a liquid flow-in port; a second storage chamber; a liquid flow-out port; and a second air communication portion. The liquid flow-in port allows the liquid, which has been supplied from the first storage chamber through the supply portion and the connecting portion connected with the supply portion, to pass though the liquid flow-in port. The second storage chamber is configured to store the liquid that has flown through the liquid flow-in port. The liquid flow-out port is disposed at a position below the liquid flow-in port and configured to allow the liquid stored in the second storage chamber to flow out of the second storage chamber. The second air communication portion allows the second storage chamber to communicate with the atmosphere. The consuming section is configured to consume the liquid flown from the second storage chamber through the liquid flow-out port. The cartridge further includes a wall defining a first base part and a first protruding part. The first storage chamber extends over insides of both of the first base part and the first protruding part. The tank further includes a wall defining a second base part and a second protruding part. The second storage chamber extends over insides of both of the second base part and the second protruding part. In a used posture of the liquid consumption apparatus, the first protruding part protrudes in a horizontal direction from an upper portion of the first base part that is defined in a vertical direction, and the second protruding part protrudes in the horizontal direction from a lower portion of the second base part that is defined in the vertical direction. In a state where the supply portion is connected to the connecting portion, the first base part and the first protruding part have the following positional relationship with the second base part and the second protruding part:

as viewed in the horizontal direction, the first base part is overlapped with both of the second base part and the second protruding part;

as viewed in the vertical direction, the first base part is not overlapped with the second base part, and is not overlapped with the second protruding part; as viewed in the horizontal direction, the first protruding part is overlapped with the second base part, but is not overlapped with the second protruding part; and as viewed in the vertical direction, the first protruding part is overlapped with the second protruding part, but is not overlapped with the second base part.

According to still another aspect, a liquid consumption apparatus includes: a first cartridge; a second cartridge; a cartridge attachment section; and a consuming device. Each of the first cartridge and the second cartridge is a cartridge which includes: a first storage chamber; and a supply portion. The first storage chamber stores a liquid. The supply portion is configured to supply the liquid stored in the first storage chamber. The cartridge attachment section includes: a connecting portion; and a tank. The connecting portion is configured to be connected with and disconnected from the supply portion of a selected one of the first cartridge and the second cartridge. The tank has a second storage chamber configured to store the liquid supplied from the first storage chamber through the supply portion and the connecting portion connected with the supply portion. The consuming device is configured to consume the liquid stored in the second storage chamber. The supply portion of a cartridge and the connecting portion are connected together in a case where the cartridge is inserted into the cartridge attachment section in an inserting direction that is parallel to a first direction. The supply portion of the cartridge and the connecting portion are separated from each other in a case where the cartridge is detached from the cartridge attachment section in a detaching direction that is opposite to the inserting direction. The first cartridge includes a wall defining both of a first base part and a first protruding part. The first protruding part protrudes in the inserting direction from part of the first base part that is defined in a second direction perpendicular to the first direction. The first storage chamber of the first cartridge extends over insides of both of the first base part and the first protruding part. The second cartridge includes a wall defining at least the first base part. The first storage chamber of the second cartridge is provided in an inside of the at least the first base part. In a case where the wall of the second cartridge defines both of the first base part and the first protruding part, the first protruding part of the second cartridge has a protruding amount smaller than that of the first protruding part of the first cartridge. The first storage chamber of the second cartridge has an internal volume smaller than that of the first storage chamber of the first cartridge. The tank includes a wall defining a second base part and a second protruding part. The second protruding part protrudes in the detaching direction from part of the second base part that is defined in the second direction. In a state where the supply portion of either one of the first cartridge and the second cartridge is connected to the connecting portion,:

as viewed in the first direction, the first base part is overlapped with both of the second base part and the second protruding part; and as viewed in the second direction, the first base part is not overlapped with the second base part, and is not overlapped with the second protruding part. In a state where the supply portion of the first cartridge is connected to the connecting portion,:

as viewed in the first direction, the first protruding part is overlapped with the second base part, but is not overlapped with the second protruding part; and as viewed in the second direction, the first protruding part is overlapped with the second protruding part, but is not overlapped with the second base part.

BRIEF DESCRIPTION OF THE DRAWINGS

The particular features and advantages of the disclosure will become apparent from the following description taken in connection with the accompanying drawings, in which:

FIGS. 1A and 1B are perspective views showing external appearances of a multifunction peripheral 10 according to an embodiment, in which FIG. 1A shows a state where a cover 87 of the multifunction peripheral is closed, and FIG. 1B shows a state where the cover 87 is open;

FIGS. 11A, 11B, and 11C illustrate other various examples of the positional relationship between a first base part and a first protruding part of an ink cartridge and a second base part and a second protruding part of a tank, wherein FIG. 11A illustrates the positional relationship between the first base part 48 and the first protruding part 49 of an ink cartridge 30A and the second base part 118 and the second protruding part 119 of a tank 103A, FIG. 11B illustrates the positional relationship between the first base part 48 and the first protruding part 49 of another ink cartridge 30B and the second base part 118 and second protruding parts 119A and 119B of another tank 103B, and FIG. 11C illustrates the positional relationship between the first base part 48 and first protruding parts 49A and 49B of still another ink cartridge 30C and the second base part 118 and the second protruding part 119 of still another tank 103C.

DETAILED DESCRIPTION

Figure 1A:
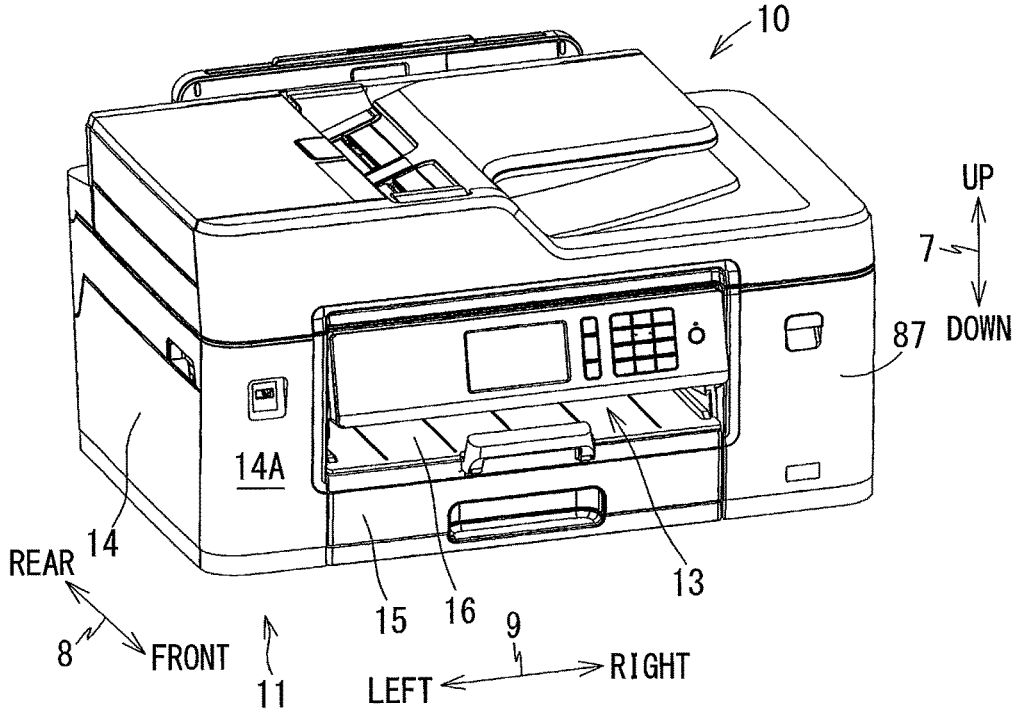

A multifunction peripheral according to an embodiment will be described while referring to the accompanying drawings wherein like parts and components are designated by the same reference numerals to avoid duplicating description.

Hereinafter, an embodiment will be described. An up-down direction 7 is defined with reference to the posture (posture illustrated in FIGS. 1A and 1B, which is referred to also as "used posture") of a multifunction peripheral 10 installed on a horizontal plane in a usable state. A surface of the multifunction peripheral 10, in which an opening 13 is provided, is defined as a front surface of the multifunction peripheral 10, and a front-rear direction 8 is defined relative to the front surface of the multifunction peripheral 10. A left-right direction 9 is defined as viewed from the front side of the multifunction peripheral 10. In the present embodiment, in the used posture, the up-down direction 7 corresponds to the vertical direction, and front-rear direction 8 and left-right direction 9 correspond to the horizontal direction. The front-rear direction 8 and left-right direction 9 are perpendicular to each other.

[Entire Configuration of Multifunction peripheral 10]

Figure 1B:
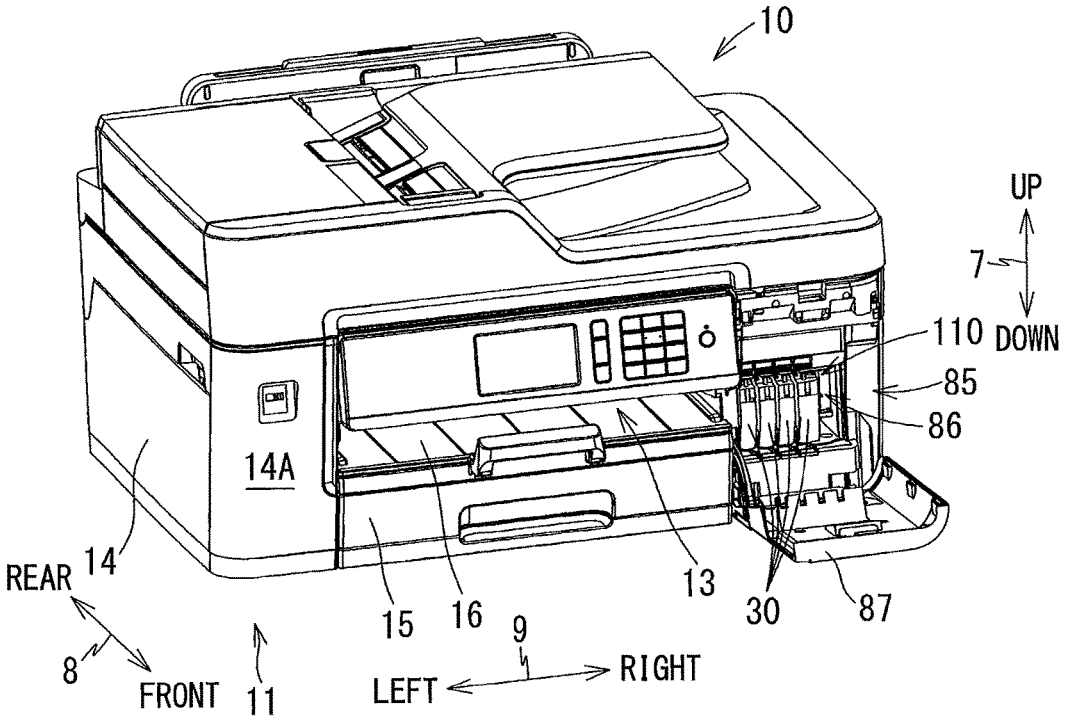
Figure 2:
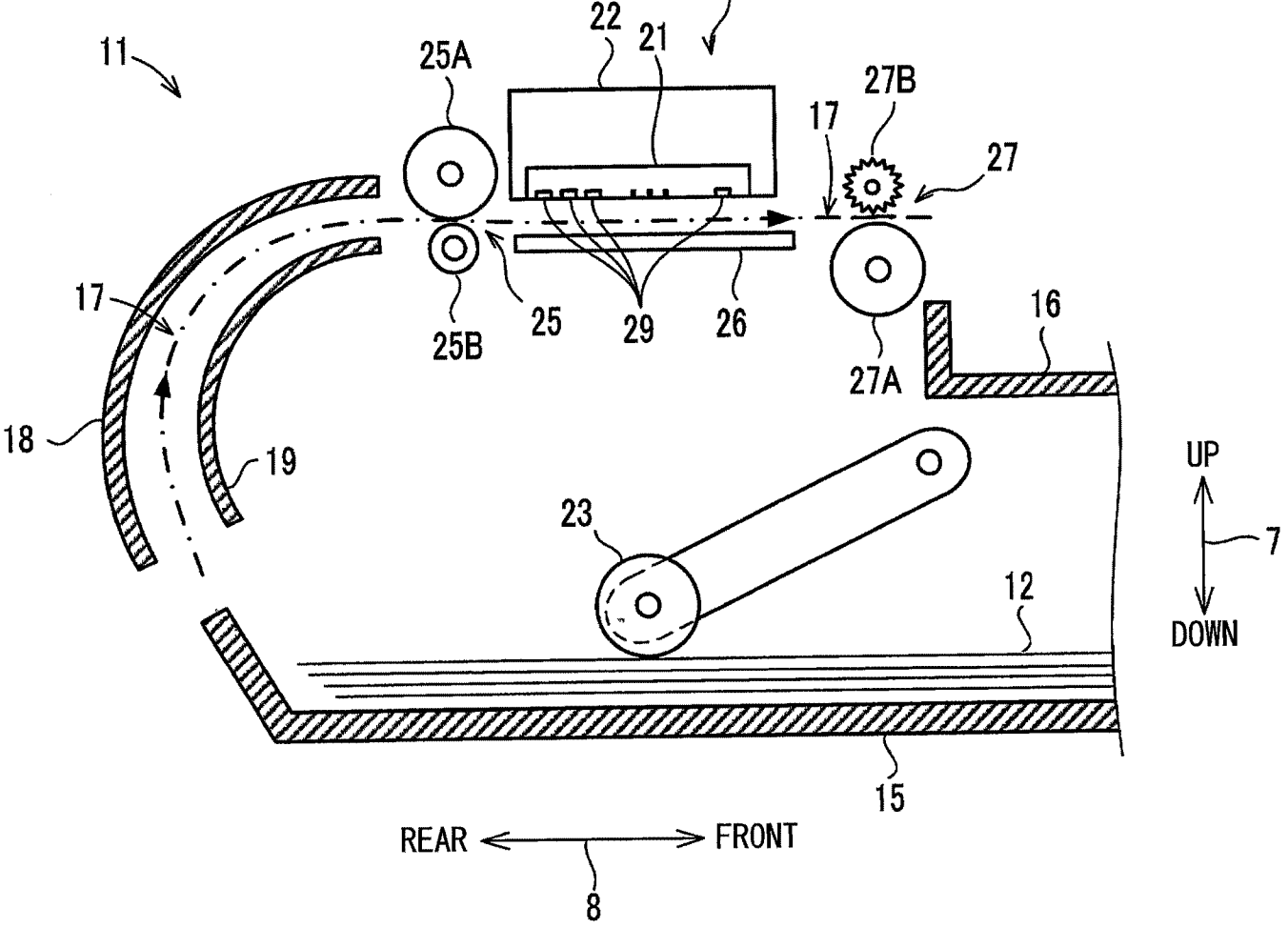
FIG. 2 is a vertical cross-sectional view schematically illustrating an internal configuration of a printer section 11 provided in the multifunction peripheral 10 shown in FIGS. 1A and 1B.

As illustrated in FIGS. 1A and 1B, the multifunction peripheral 10 has, at its lower portion, a printer part 11 that records an image on a paper sheet 12 (see FIG. 2) using an inkjet recording system. The multifunction peripheral 10 may have various functions such as a facsimile function, a scan function, and a copy function. The multifunction peripheral 10 is an example of a liquid consumption apparatus. The printer part 11 has a housing 14 of substantially a rectangular parallelepiped shape. As illustrated in FIG. 2, inside the housing 14, there are provided a feed tray 15, a discharge tray 16, a feed roller 23, a conveying roller pair 25, a discharge roller pair 27, a recording part 24, and a platen 26.

[Feed Tray 15, Discharge Tray 16, Feed Roller 23]

As illustrated in FIGS. 1A and 1B, the opening 13 is formed in a front surface 14A of the housing 14 at substantially the center of the housing 14 in the left-right direction 9. The feed tray 15 can be inserted into and removed from the housing 14 in the front-rear direction 8 through the opening 13. The feed tray 15 supports a plurality of stacked paper sheets 12. The discharge tray 16 is disposed above the feed tray 15. The discharge tray 16 supports a paper sheet 12 which has been discharged by the discharge roller pair 27 from between the recording part 24 and the platen 26. The feed roller 23 is driven by an unillustrated motor to feed the paper sheet 12 supported by the feed tray 15 to a conveying path 17.

[Conveying Path 17]

As illustrated in FIG. 2, the conveying path 17 is a space defined by guide members 18 and 19, the recording part 24, the platen 26, and the like. Inside the printer part 11, the guide members 18 and 19 are opposed to each other, with a predetermined interval being formed therebetween, and the recording part 24 and platen 26 are opposed to each other, with a predetermined interval being formed therebetween. The conveying path 17 extends upward from the rear end portion of the feed tray 15 while making a U-turn, passes through a position facing the recording part 24, and reaches the discharge tray 16. The direction of sheet conveyance is denoted by an arrow indicated by one dot chain line in FIG. 2.

[Conveying Roller Pair 25]

The conveying roller pair 25 is disposed upstream of the recording part 24 in the conveying direction. The conveying roller pair 25 includes a conveying roller 25A and a pinch roller 25B which are opposed to each other. The conveying roller 25A is driven by the unillustrated motor. The pinch roller 25B is rotated following the rotation of the conveying roller 25A. The paper sheet 12 is held between the conveying roller 25A and the pinch roller 25B, while the conveying roller 25A is rotated in a normal direction by a normal-rotation drive force transmitted from the motor, thereby to be conveyed in the conveying direction.

[Discharge Roller Pair 27]

The discharge roller pair 27 is disposed downstream of the recording part 24 in the conveying direction. The discharge roller pair 27 includes a discharge roller 27A and a spur 27B which are opposed to each other. The discharge roller 27A is driven by the unillustrated motor. The spur 27B is rotated following the rotation of the discharge roller 27A. The paper sheet 12 is held between the discharge roller 27A and the spur 27B, while the discharge roller 27A is rotated in the normal direction by a normal-rotation drive force transmitted from the motor, thereby to be conveyed in the conveying direction.

[Recording Part 24, Platen 26]

As illustrated in FIG. 2, the recording part 24 and platen 26 are disposed at a location between the conveying roller pair 25 and the discharge roller pair 27 in the conveying direction. More specifically, the recording part 24 and platen 26 are disposed downstream of the conveying roller pair 25 and upstream of the discharge roller pair 27 in the conveying direction. Further, the recording part 24 and platen 26 are disposed opposite to each other in the up-down direction 7.

The recording part 24 includes a carriage 22 and a recording head 21 mounted on the carriage 22. The carriage 22 receives drive force from the unillustrated motor to reciprocally move in the left-right direction 9. A plurality of nozzles 29 are formed in the lower surface of the recording head 21. The recording head 21 oscillates oscillation elements such as piezoelectric elements to eject ink droplets from the nozzles 29. In the process of movement of the carriage, the recording head 21 selectively ejects ink droplets toward the paper sheet 12 supported by the platen 26 to thereby record an image on the paper sheet 12.

The carriage 22 is connected with ink tubes and a flexible flat cable. The ink tubes connect a cartridge attachment section 110 (see FIG. 1B) to be described later and the recording head 21. More specifically, each ink tube supplies ink stored in each of ink cartridges 30 (an example of a cartridge) attached to the cartridge attachment section 110 to the recording head 21. The ink tubes are a bundle of four tubes through which inks of respective colors (black, magenta, cyan, and yellow) flow. The flexible flat cable electrically connects the recording head 21 with a control board for controlling the operation of the multifunction peripheral 10.

[Cover 87]

An opening 85 is formed in the front surface 14A of the housing 14 at the right end portion thereof in the left-right direction 9. The housing 14 has a cover 87 that can be pivotally moved between a closed position (position illustrated in FIG. 1A), at which the cover 87 closes the opening 85, and an open position (position illustrated in FIG. 1B), at which the cover 87 opens the opening 85. The cover 87 is supported by the housing 14 at a position near to the lower end of the housing 14 in the up-down direction 7 so as to be pivotally movable about a pivot axis extending in the left-right direction 9. A housing space 86 is formed inside the housing 14 so as to extend from the opening 85 toward the rear side of the housing 14. The cartridge attachment section 110 is disposed in the housing space 86.

[Cartridge Attachment Section 110]

Figure 3:
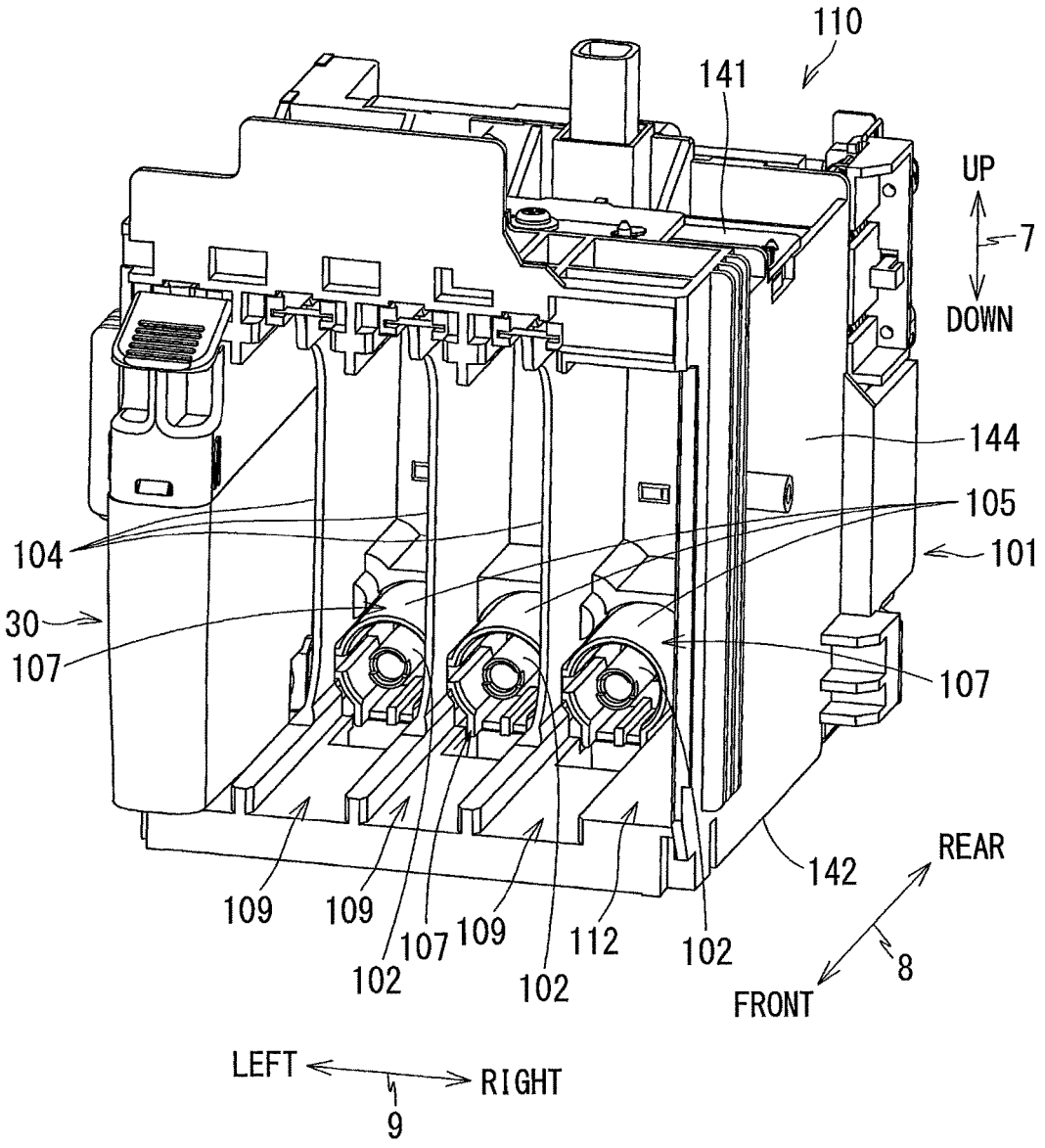
FIG. 3 is a perspective view showing an external appearance of a cartridge attachment section 110 of the multifunction peripheral 10 viewed from a side of the cartridge attachment section 110 on which an opening 112 is provided.
Figure 4:
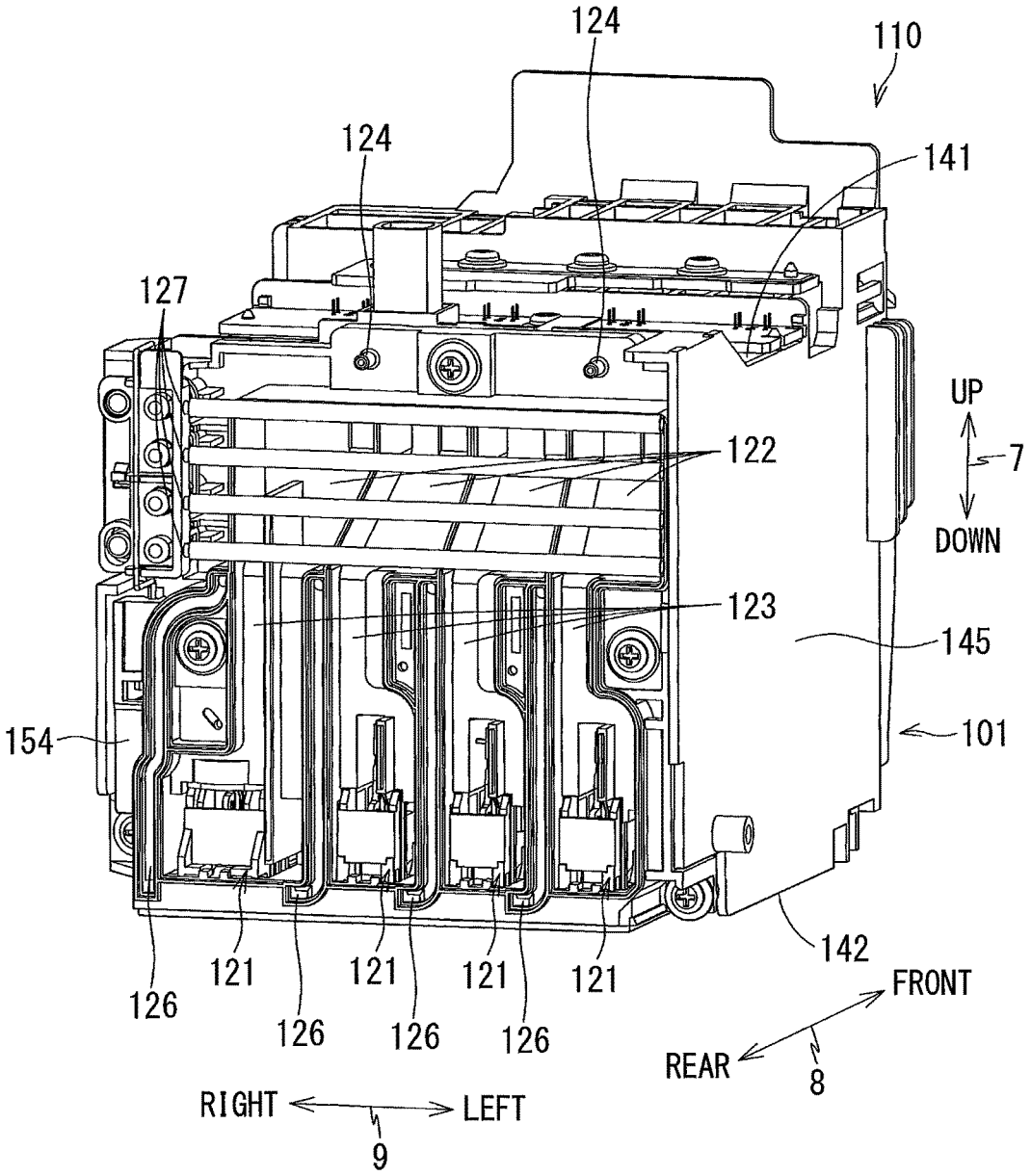
FIG. 4 is a perspective view showing an external appearance of the cartridge attachment section 110 viewed from a side of the cartridge attachment section 110 on which tanks 103 are provided.
Figure 5:
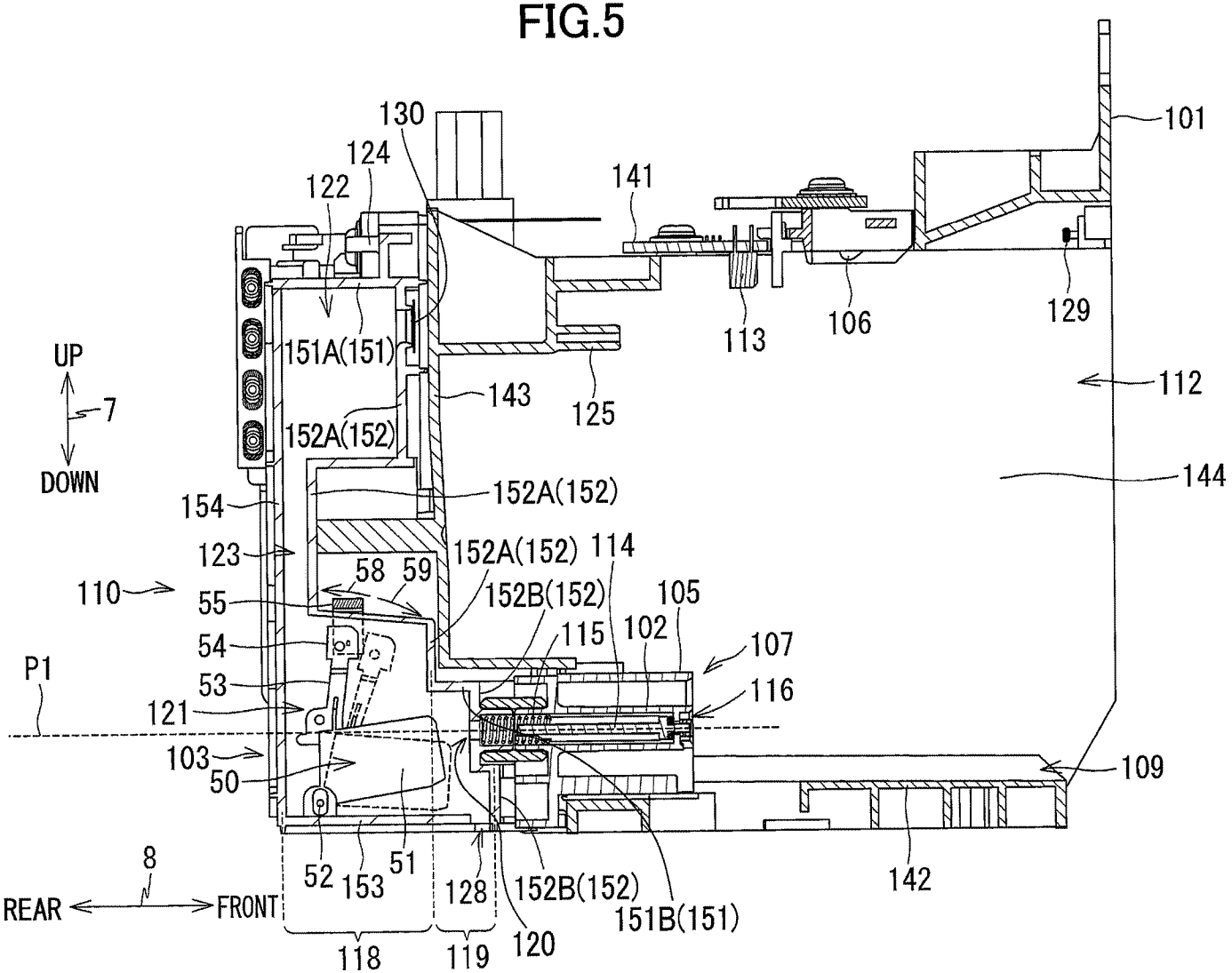
FIG. 5 is a vertical cross-sectional view of the cartridge attachment section 110.

As illustrated in FIGS. 3 to 5, the cartridge attachment section 110 includes: a cartridge-housing case 101; a plurality of sets of contacts 106; a plurality of rods 125; a plurality of attachment sensors 113; a locking part 129; a plurality of tanks 103; and a plurality of liquid surface sensors 55 (examples of a sensor). In this embodiment, four ink cartridges 30 for cyan, magenta, yellow, and black colors can be housed in the cartridge attachment section 110. Accordingly, four sets of contacts 106, four rods 125, four attachment sensors 113, four tanks 103, and four liquid surface sensors 55 are provided corresponding to the respective four ink cartridges 30. It is noted, however, that the number of the ink cartridges 30 that can be attached to the cartridge attachment section 110 is not limited to four (4).

[Cartridge-Housing Case 101]

The cartridge-housing case 101 forms a casing of the cartridge attachment section 110. The cartridge-housing case 101 has a box shape having an inner space for housing the ink cartridges 30 therein. The cartridge-housing case 101 has: a top wall 141 defining the upper end of the inner space of the cartridge-housing case 101; a bottom wall 142 defining the lower end of the inner space of the cartridge-housing case 101; a rear wall 143 defining the rear end of the inner space of the cartridge-housing case 101 in the front-rear direction 8; and a pair of side walls 144 and 145 defining a pair of opposite ends of the inner space of the cartridge-housing case 101 in the left-right direction 9. On the other hand, the front end of the cartridge-housing case 101 that is opposed to the rear wall 143 in the front-rear direction 8 has an opening 112 through which the inner space of the cartridge-housing case 101 is exposed. The opening 112 is exposed outside the multifunction peripheral 10 through the opening 85 of the housing 14 when the cover 87 is at the open position.

Each ink cartridge 30 is inserted into the cartridge attachment section 110 in the rearward direction (an example of an inserting direction) along the front-rear direction 8 through the opening 85 of the housing 14 and opening 112 of the cartridge attachment section 110, and is removed from the cartridge attachment section 110 in the forward direction (an example of a detaching direction) along the front-rear direction 8. The bottom end portion of each ink cartridge 30 is inserted into a corresponding one of guide grooves 109, which are provided on the bottom wall 142 at respective positions that are apart from one another in the left-right direction 9, whereby the ink cartridge 30 is guided in the front-rear direction 8. Three plates 104 are provided in the cartridge-housing case 101 for partitioning the inner space into four spaces adjacent to each other in the left-right direction 9. Four ink cartridges 30 storing inks of respectively different colors are housed in their corresponding spaces partitioned by the plates 104.

[Contacts 106]

As illustrated in FIG. 5, each set of contacts 106 is disposed on the top wall 141 of the cartridge-housing case 101. Each set of contacts 106 has a plurality of contacts 106. The contacts 106 in each set protrude from the top wall 141 downward toward the inner space of the cartridge-housing case 101. The contacts 106 in each set are disposed at positions such that the contacts 106 will contact electrodes 65 (to be described later) of an ink cartridge 30 when the ink cartridge 30 is attached to the cartridge attachment section 110. Each contact 106 is made of a member having conductivity and elasticity and is capable of being deformed upward. The contacts 106 in each set are electrically connected to the control board through an electric circuit. When the contacts 106 in each set and the electrodes 65 of an ink cartridge 30 are brought into contact with each other and are electrically conducted with each other, a voltage Vc is applied to one of the electrodes 65 and another electrode 65 is electrically grounded, as a result of which power is supplied to an IC substrate 64 of the ink cartridge 30 to be described later. The contacts 106 are an example of a reading device that reads out information held by the IC substrate 64.

[Rod 125]

As illustrated in FIG. 5, each rod 125 protrudes forwardly from the rear wall 143 of the cartridge-housing case 101. On the rear wall 143 of the cartridge-housing case 101, the rod 125 is disposed above a connection part 107 to be described later. In a state where the ink cartridge 30 is attached to the cartridge attachment section 110, the rod 125 enters an air valve chamber 36 of the ink cartridge 30 through an air communication port 96 of the ink cartridge 30 to be described later.

[Attachment Sensor 113]

As illustrated in FIG. 5, each attachment sensor 113 is provided on the top wall 141 of the cartridge-housing case 101. Each attachment sensor 113 detects whether or not a corresponding ink cartridge 30 is attached to the cartridge attachment section 110. Each attachment sensor 113 is disposed forward of a corresponding rod 125 and rearward of the corresponding set of contacts 106. Each attachment sensor 113 according to the present embodiment includes a light emitting part and a light receiving part disposed apart from each other in the left-right direction 9. A light shielding plate 67 (to be described later) of the ink cartridge 30 attached to the cartridge attachment section 110 is disposed between the light emitting part and the light receiving part. In other words, the light emitting part and light receiving part are disposed as opposed to each other across the light shielding plate 67 of the ink cartridge 30 attached to the cartridge attachment section 110.

The attachment sensor 113 outputs different detection signals according to whether or not light emitted from the light emitting part in the left-right direction 9 is received by the light receiving part. For example, the attachment sensor 113 outputs a low level signal to the control board when the light outputted from the light emitting part is not received by the light receiving part (that is, intensity of a received light is smaller than a predetermined level). On the other hand, the attachment sensor 113 outputs a high level signal to the control board when the light outputted from the light emitting part is received by the light receiving part (that is, intensity of a received light is larger than or equal to the predetermined level). The attachment sensor 113 is an example of a reading device that reads out information held by the light shielding plate 67.

[Locking Part 129]

As illustrated in FIG. 5, the locking part 129 extends in the left-right direction 9 of the cartridge-housing case 101 near to both of the top wall 141 and the opening 112. The locking part 129 is a rod-like member extending in the left-right direction 9. For example, the locking part 129 is a column made of metal. Both of opposite ends of the locking part 129 in the left-right direction are fixed to the side walls 144 and 145 of the cartridge-housing case 101, respectively. The locking part 129 extends in the left-right direction 9 over the four spaces corresponding respectively to the four ink cartridges 30.

Figure 9:
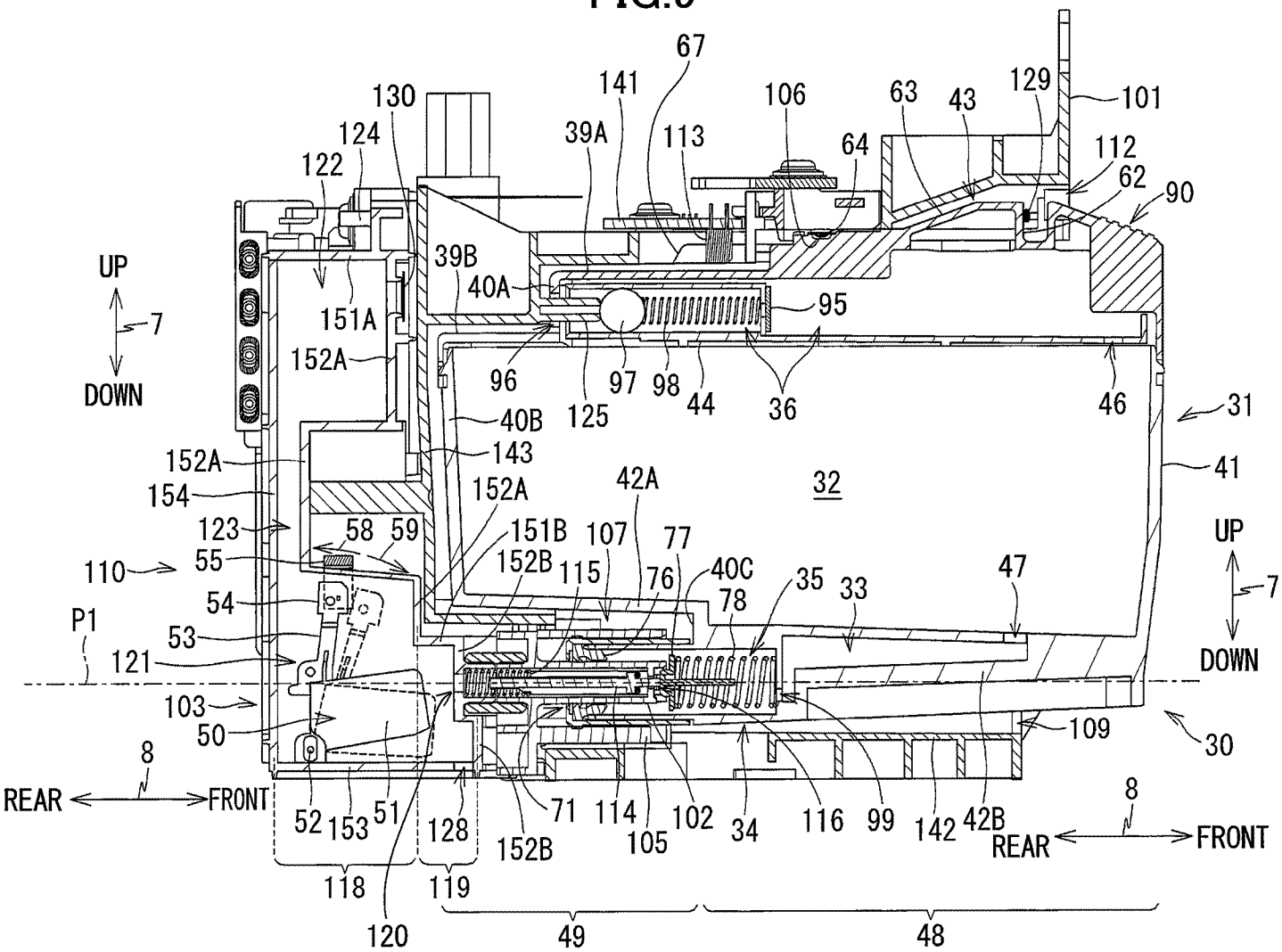
FIG. 9 is a vertical cross-sectional view of the cartridge attachment section 110, in which the ink cartridge 30 is attached.

The locking part 129 holds each ink cartridge 30 attached to the cartridge attachment section 110 at the attachment position illustrated in FIG. 9. The ink cartridge 30 is engaged with the locking part 129 in a state where the ink cartridge 30 is attached to the cartridge attachment section 110. As a result, the locking part 129 holds the ink cartridge 30 in the cartridge attachment section 110 against the urging force of coil springs 78, 98, and 115 that urge the ink cartridge 30 forward.

[Tanks 103]

As illustrated in FIG. 5, the tanks 103 are provided rearward of the rear wall 143 of the cartridge-housing case 101. The tanks 103 are constituted by an upper wall 151, a front wall 152, a lower wall 153, a rear wall 154, and the pair of side walls 144 and 145. Of the above-mentioned walls constituting the tanks 103, at least parts of the walls that face liquid surface sensors 55 to be described later have translucency allowing transmission of light outputted from the liquid surface sensors 55.

At least a part of the rear wall 154 may be formed of a film welded to the end faces of the respective upper wall 151, lower wall 153, and side walls 144 and 145. Further, in the above description, the side walls 144 and 145 serve as side walls of both of the cartridge-housing case 101 and the tanks 103. However, the side walls of the tanks 103 may be provided separately from the side walls 144 and 145 of the cartridge-housing case 101. Further, the four tanks 103 that are arranged adjacent to one another in the left-right direction 9 are partitioned by unillustrated partition walls. The four tanks 103 have substantially the same configuration with one another.

The upper wall 151 is composed of a first upper wall 151A and a second upper wall 151B. The first upper wall 151A is positioned rearward of the second upper wall 151B in the front-rear direction 8 and above the second upper wall 151B in the up-down direction 7. The front wall 152 is composed of a first front wall 152A and a second front wall 152B. The first front wall 152A is positioned rearward of the second front wall 152B in the front-rear direction 8 and above the second front wall 152B in the up-down direction 7. The first front wall 152A is connected to both of the front end of the first upper wall 151A and the rear end of the second upper wall 151B. The upper end of the second front wall 152B is connected to the front end of the second upper wall 151B. A connection part 107 is provided on the second front wall 152B. A first communication port 120 (an example of a liquid flow-in port) is formed through the second front wall 152B to communicate the connection part 107 with a storage chamber 121 of the tank 103 to be described later.

The first upper wall 151A may be composed of a greater number of walls. The same can be applied to each of the second upper wall 151B, first front wall 152A, and second front wall 152B. (The same can be applied also to each of a first upper wall 39A, a second upper wall 39B, a first rear wall 40A, a second rear wall 40B, a third rear wall 40C, a first lower wall 42A, and a second lower wall 42B of the ink cartridge 30 to be described later).

As illustrated in FIG. 5, each tank 103 is divided into a second base part 118 and a second protruding part 119. The second base part 118 is, for example, a part of the tank 103 that is surrounded by: the first front wall 152A; first upper wall 151A; rear wall 154; and a rear part of the lower wall 153. The second protruding part 119 is, for example, a part of the tank 103 that is surrounded by: the second upper wall 151B; second front wall 152B; and a front part of the lower wall 153. In other words, the second protruding part 119 protrudes forward from a part of the second base part 118 defined in the up-down direction 7. More specifically, the second protruding part 119 protrudes forward from the lower portion of the second base part 118 defined in the up-down direction 7. The boundary between the second base part 118 and the second protruding part 119 in the front-rear direction 8 may be, for example, the extension line of the first front wall 152A. The second protruding part 119 is disposed at a position rearward of the contacts 106 and the attachment sensor 113 in the front-rear direction 8.

The tank 103 has a box shape, and has a storage chamber 121 and a buffer chamber 122 therein. The storage chamber 121 and buffer chamber 122 are arranged in the up-down direction 7 with the buffer chamber 122 positioned above the storage chamber 121. The storage chamber 121 and buffer chamber 122 communicate with each other through a flow path 123 extending in the up-down direction 7. The storage chamber 121, buffer chamber 122, and flow path 123 are an example of a second storage chamber. The storage chamber 121 is formed to extend over the insides of both of the second base part 118 and the second protruding part 119. Accordingly, the horizontal cross sectional area of a part of the storage chamber 121 that is positioned below the second upper wall 151B is larger than the horizontal cross sectional areas of: a part of the storage chamber 121 that is positioned above the second upper wall 151B; the buffer chamber 122; and flow path 123.

The storage chamber 121 communicates with the connection part 107 through the first communication port 120 (an example of a liquid flow-in port), and communicates with an ink flow path 126 (FIG. 4) through a second communication port 128 (an example of a liquid flow-out port). The second communication port 128 is formed in the lower wall 153 defining the lower end of the storage chamber 121. The second communication port 128 is positioned below the first communication port 120 in the up-down direction 7. As shown in FIG. 4, the ink flow path 126 extends upward from the second communication port 128 and communicates with a corresponding ink flow-out port 127. The ink flow-out port 127 is connected with the corresponding ink tube. Thus, ink stored in the storage chambers 121 flows out from the second communication port 128 so as to be supplied to the recording head 21 through the ink flow path 126 and ink tube.

The buffer chamber 122 is in communication with an air communication port 124 (an example of a second air communication portion) provided at the upper portion of the tank 103. More specifically, an air flow path is provided between the buffer chamber 122 and the air communication port 124 to establish communication between the buffer chamber 122 and the air communication port 124. As shown in FIG. 5, a semipermeable membrane 130 is provided in the air flow path between the buffer chamber 122 and the air communication port 124. With this configuration, the storage chamber 121, buffer chamber 122, and flow path 123 communicate with the atmosphere through the air communication port 124. The air communication port 124 may be opened and closed under the control by the control board. Further, an unillustrated labyrinth passage may be provided in place of the semipermeable membrane 130 in the air flow path between the buffer chamber 122 and the air communication port 124. However, the semipermeable membrane 130 or the labyrinth passage may not be provided in the air flow path between the buffer chamber 122 and the air communication port 124.

[Connection Part 107]

The connection part 107 includes: a tubular-shaped ink needle 102 (an example of a second cylindrical part) made of resin; and a guide part 105. The ink needle 102 protrudes forward from the second front wall 152B. An opening 116 is formed in the protruding end (tip end) of the ink needle 102. The inner space of the ink needle 102 communicates with the inside of the storage chamber 121 through the first communication port 120. The ink needle 102 is disposed at a position corresponding to an ink supply part 34 (an example of a supply portion) of the ink cartridge 30 mounted in the cartridge attachment section 110.

The guide part 105 is a cylindrical member disposed around the ink needle 102. The guide part 105 protrudes forward from the second front wall 152B. An opening is formed in the protruding end (tip end) of the guide part 105. The ink needle 102 is disposed to extend along the central axis of the cylindrical guide part 105. When the ink cartridge 30 is attached to the cartridge attachment section 110, the ink supply part 34 enters the inside of the guide part 105.

A valve 114 and a coil spring 115 are housed in the inner space of the ink needle 102. The valve 114 is configured to move in the front-rear direction 8 between a closed position, at which the valve 114 closes the opening 116, and an open position, at which the valve 114 opens the opening 116. The coil spring 115 biases the valve 114 in the forward direction to move the valve 114 to the closed position. The front end of the valve 114 at the closed position protrudes further forward from the opening 116 of the ink needle 102.

[Pivot Member 50]

As illustrated in FIG. 5, a pivot member 50 is disposed inside the storage chamber 121. The pivot member 50 is supported by an unillustrated support member disposed inside the storage chamber 121 in a manner that the pivot member 50 is pivotally movable in directions denoted by the arrows 58 and 59. The pivot member 50 can pivotally move between the position denoted by the solid line in FIG. 5 and the position denoted by the dashed line. Further, the pivot member 50 is restricted by an unillustrated restricting member from moving pivotally in the direction of the arrow 58 further from the position indicated by the solid line. The pivot member 50 includes a float 51, shafts 52, an arm 53, and a detected part 54 (an example of a detected portion).

The pivot member 50 has the float 51 at its lower portion. The float 51 is formed of a material having a specific gravity smaller than that of ink stored in the storage chamber 121. The shafts 52 protrude from the right and left surfaces of the float 51 outwardly in the left-right direction 9. The shafts 52 are inserted into holes formed in the support member. With this configuration, the pivot member 50 is supported by the support member so as to be pivotally movable about the shafts 52. The arm 53 protrudes substantially upward from the float 51. The detected part 54 is formed at the protruding end (tip end) of the arm 53. The detected part 54 is formed into a plate shape extending in both of the up-down direction 7 and front-rear direction 8. The detected part 54 is formed of a material that shields light outputted from the light emitting part of a liquid surface sensor 55 to be described later.

When the liquid surface of ink is higher than a boundary position P1, the pivot member 50 pivotally moves in the direction of the arrow 58 due to buoyancy and is maintained at a position indicated by the solid line in FIG. 5 by the restricting member. The position of the detected part 54 of the pivot member 50 denoted by the solid line in FIG. 5 is an example of a detection position. On the other hand, when the level of the liquid surface of ink is lower than or equal to the boundary position P1, the pivot member 50 pivotally moves in the direction of the arrow 59 due to gravitational force which increases in association with the lowering of the level of the liquid surface. As a result, the detected part 54 moves to a position that is shifted from the detection position. That is, the detected part 54 moves to a position corresponding to the amount of ink stored in the storage chamber 121.

The boundary position P1 according to the present embodiment is a position defined in the up-down direction 7 at the same height with both of: the axial center of the ink needle 102; and the center of an ink supply port 71 of the ink cartridge 30 to be described later. However, the boundary position P1 is not limited to the above-described position as long as the boundary position P1 is positioned above the second communication port 128 in the up-down direction 7. Alternatively, the boundary position P1 may be set at the same height with: the upper or lower end of the internal space of the ink needle 102; or the upper or lower end of the ink supply port 71. The boundary position P1 is desirably below the second upper wall 151B.

[Liquid Surface Sensor 55]

Each liquid surface sensor 55 is configured to detect whether or not the detected part 54 of the pivot member 50 provided in the corresponding tank 103 is located at the detection position. The liquid surface sensor 55 according to the present embodiment includes a light emitting part and a light receiving part disposed apart from each other in the left-right direction 9. The liquid surface sensor 55 outputs different detection signals according to whether or not light emitted from the light emitting part is received by the light receiving part. That is, the concrete configuration of the liquid surface sensor 55 may be the same as that of the attachment sensor 113.

When the liquid surface of ink stored in the storage chamber 121 is higher than the boundary position P1, light outputted from the light emitting part is shielded by the detected part 54 and is thus not received by the light receiving part. Thus, in this case, the liquid surface sensor 55 outputs a low level signal to the control board. On the other hand, when the liquid surface of ink stored in the storage chamber 121 is lower than or equal to the boundary position P1, light outputted from the light emitting part is received by the light receiving part. Thus, in this case, the liquid surface sensor 55 outputs a high level signal to the control board. That is, the liquid surface sensor 55 detects whether or not the liquid surface of ink stored in the storage chamber 121 is higher than the boundary position P1 according to the position of the detected part 54. A combination of the liquid surface sensor 55 and the detected part 54 is an example of a detector.

[Ink Cartridge 30]

Figure 6:
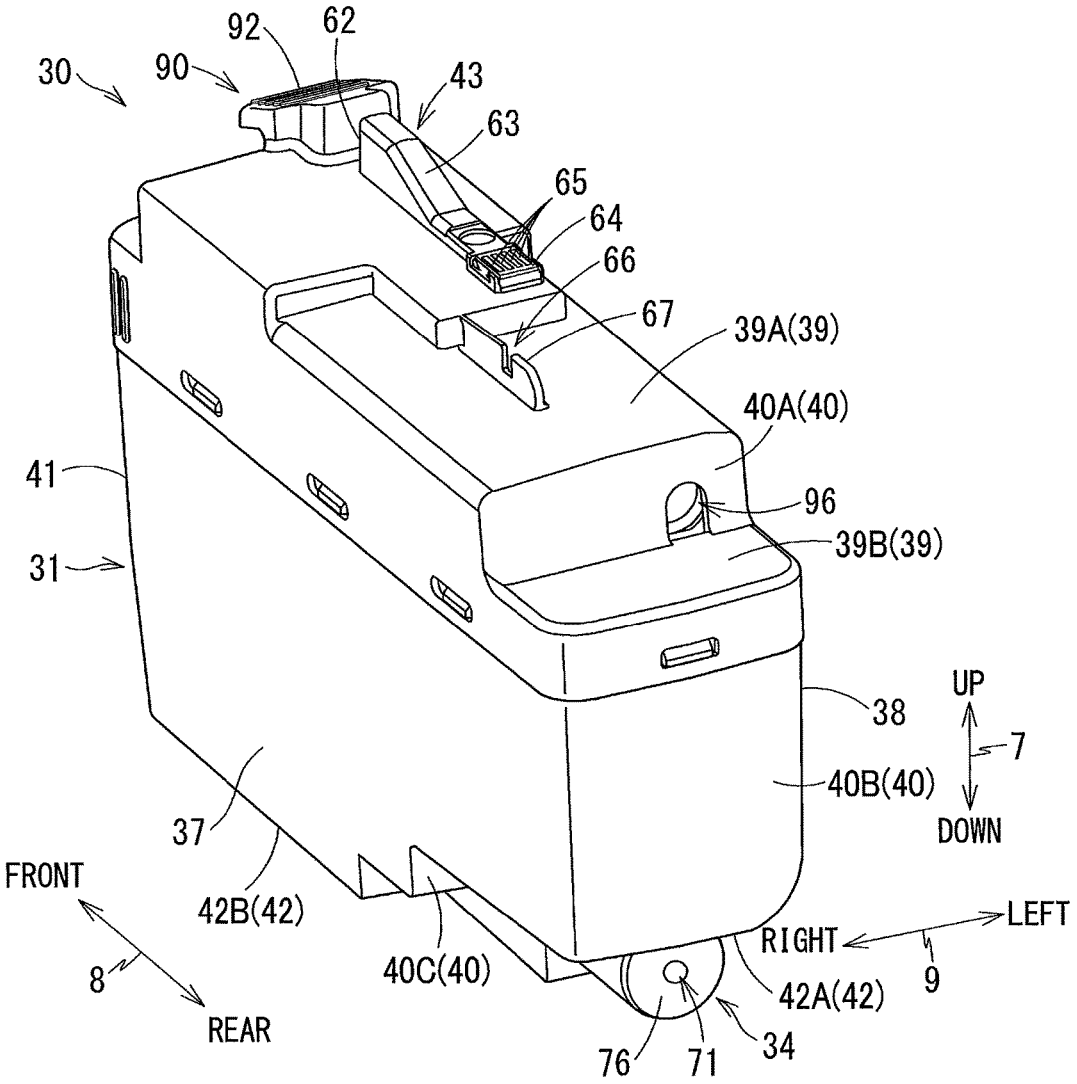
FIG. 6 is a perspective view of an ink cartridge 30 viewed from a rear side thereof.
Figure 7:
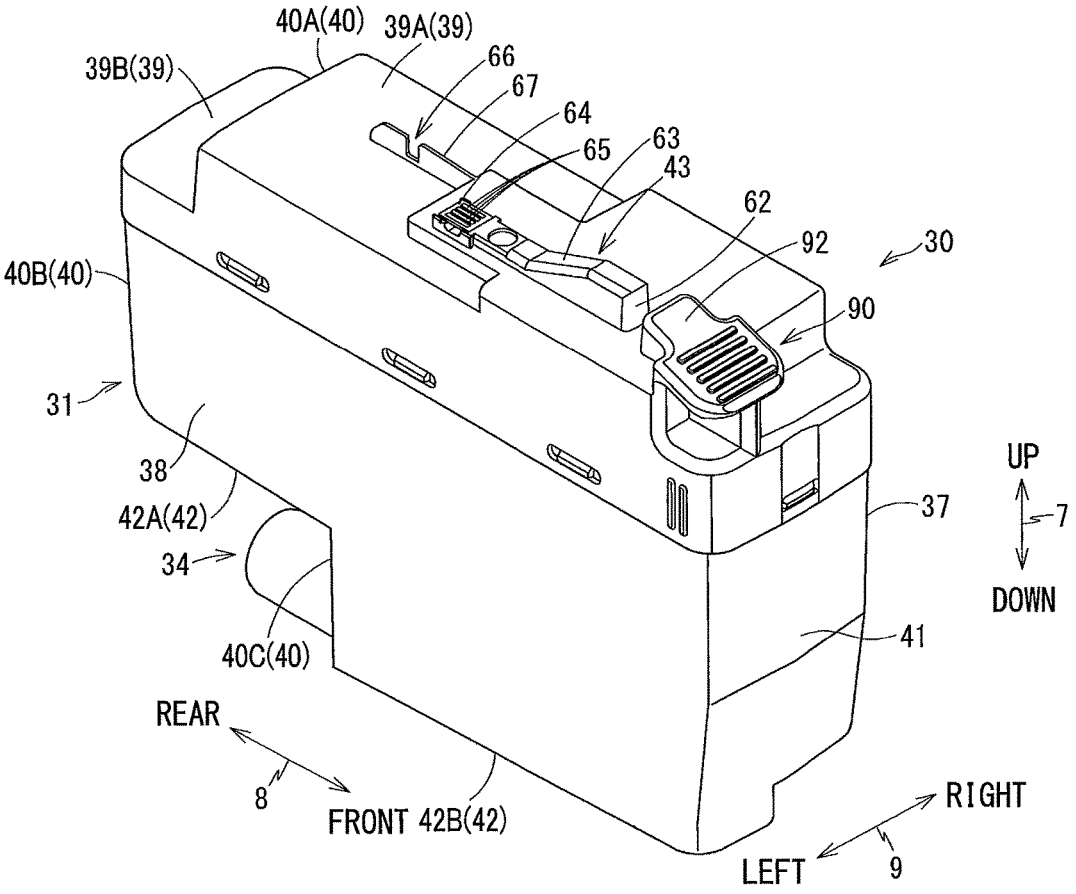
FIG. 7 is a perspective view of the ink cartridge 30 viewed from a front side thereof.
Figure 8:
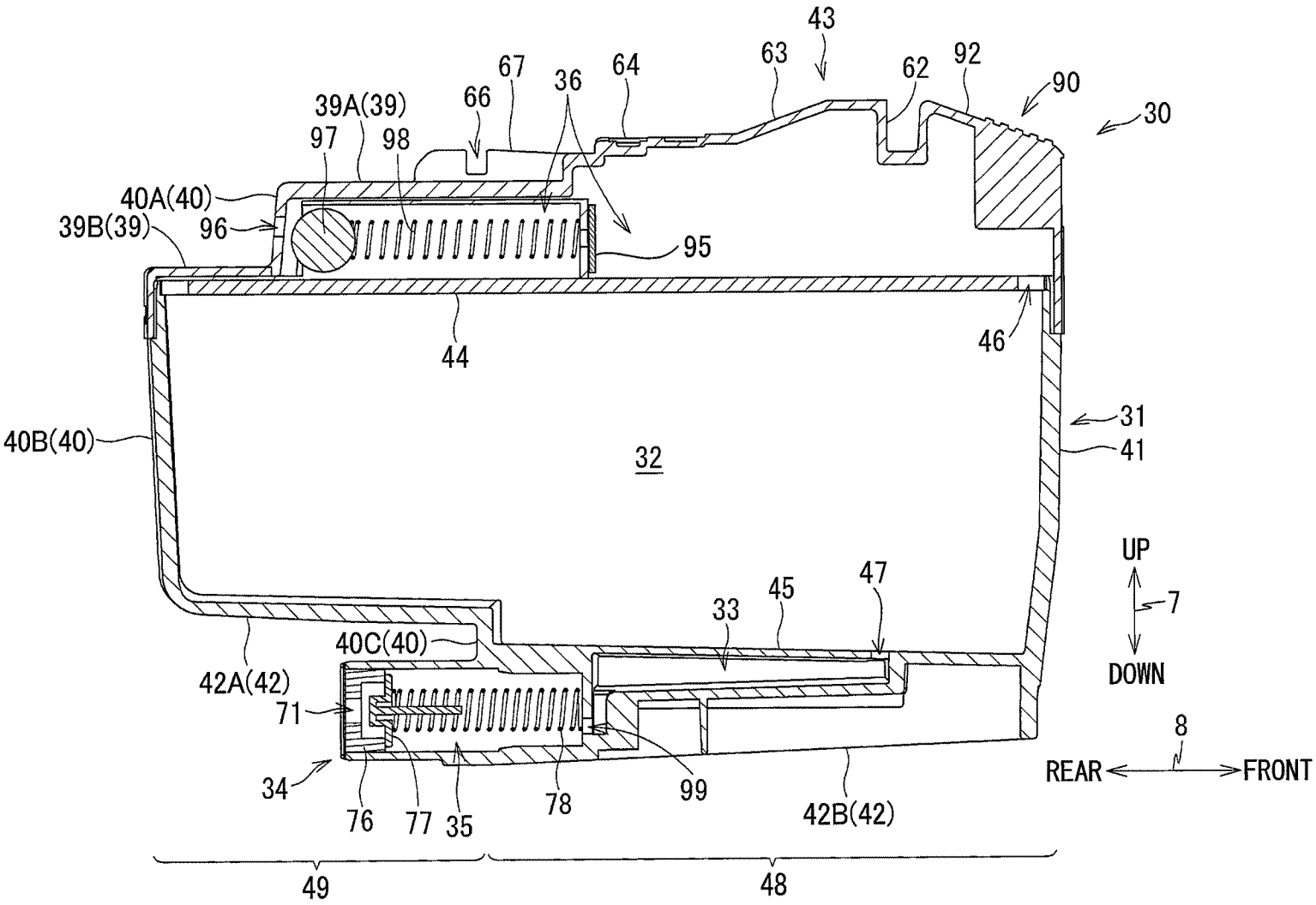
FIG. 8 is a vertical cross-sectional view of the ink cartridge 30.

The ink cartridge 30 is a container, in which ink is stored. As illustrated in FIGS. 6 to 8, the ink cartridge 30 has a casing 31 of a substantially rectangular parallelepiped shape. The casing 31 has a flat shape such that dimensions of the casing 31 in the up-down direction 7 and front-rear direction 8 are larger than the dimension of the casing 31 in the left-right direction 9. The outer shapes of the ink cartridges 30 storing inks of respectively different colors may be the same with or different from one another. The casing 31 is constituted by a rear wall 40, a front wall 41, an upper wall 39, a lower wall 42, and side walls 37 and 38. Of the walls constituting the casing 31, at least the front wall 41 has translucency allowing the liquid surface of ink stored in an upper storage chamber 32 and a lower storage chamber 33 (to be described later) to be visible from outside.

The rear wall 40 is composed of a first rear wall 40A, a second rear wall 40B, and a third rear wall 40C. The first rear wall 40A is positioned forward of the second rear wall 40B in the front-rear direction 8 and upward of the second rear wall 40B in the up-down direction 7. The second rear wall 40B is positioned rearward of the third rear wall 40C in the front-rear direction 8 and upward of the third rear wall 40C in the up-down direction 7. The third rear wall 40C is positioned forward of the first rear wall 40A in the front-rear direction 8 and downward of the first rear wall 40A in the up-down direction 7. An air communication port 96 is formed at the first rear wall 40A, and the ink supply part 34 is provided at the third rear wall 40C.

The upper wall 39 is composed of a first upper wall 39A and a second upper wall 39B. The first upper wall 39A is positioned forward of the second upper wall 39B in the front-rear direction 8 and upward of the second upper wall 39B in the up-down direction 7. The rear end of the first upper wall 39A is connected to the upper end of the first rear wall 40A. The front end of the first upper wall 39A is connected to the upper end of the front wall 41. Further, the second upper wall 39B is connected to both of the lower end of the first rear wall 40A and the upper end of the second rear wall 40B. On the first upper wall 39A, a convex part 43, an operation part 90, the light shielding plate 67, and the IC substrate 64 are provided.

The lower wall 42 is composed of a first lower wall 42A and a second lower wall 42B. The first lower wall 42A is positioned rearward of the second lower wall 42B in the front-rear direction 8 and upward of the second lower wall 42B in the up-down direction 7. The first lower wall 42A is connected to both of the lower end of the second rear wall 40B and the upper end of the third rear wall 40C. The second lower wall 42B is connected to the lower ends of both of the third rear wall 40C and the front wall 41.

As illustrated in FIG. 8, the casing 31 of the ink cartridge 30 is divided into a first base part 48 and a first protruding part 49. The first base part 48 is, for example, a part of the casing 31 that is surrounded by: a front part of the first upper wall 39A; the front wall 41; the second lower wall 42B; the third rear wall 40C; a front part of the side wall 37; and a front part of the side wall 38. The first protruding part 49 is, for example, a part of the casing 31 that is surrounded by: a rear part of the first upper wall 39A; the first rear wall 40A; the second upper wall 39B; the second rear wall 40B; the first lower wall 42A; a rear part of the side wall 37; and a rear part of the side wall 38.

That is, the first protruding part 49 protrudes rearward from a part of the first base part 48 defined in the up-down direction 7. More specifically, the first protruding part 49 protrudes rearward from the upper portion of the first base part 48 defined in the up-down direction 7. The boundary between the first base part 48 and the first protruding part 49 in the front-rear direction 8 may be: the extension line of the first rear wall 40A; the extension line of the third rear wall 40C; or a virtual line connecting the lower end of the first rear wall 40A and the upper end of the third rear wall 40C.

The convex part 43 protrudes upward from the outer surface of the first upper wall 39A and extends in the front-rear direction 8. More specifically, the convex part 43 is desirably provided at the first base part 48. A surface of the convex part 43 that faces forward is defined as a lock surface 62. The lock surface 62 is positioned above the first upper wall 39A. In a state where the ink cartridge 30 is attached to the cartridge attachment section 110, the lock surface 62 is in abutment with the locking part 129. The abutment between the lock surface 62 and the locking part 129 maintains the ink cartridge 30 to be held at the attachment position against the biasing force of the coil springs 78, 98, and 115.

An inclined surface 63 is formed on the convex part 43 at an opposite side of the lock surface 62 in the front-rear direction 8. In the process of attachment of the ink cartridge 30 to the cartridge attachment section 110, the locking part 129 is guided along the inclined surface 63. As a result, the locking part 129 is guided to a position, at which the locking part 129 abuts against the lock surface 62. The state where the lock surface 62 is in abutment with the locking part 129 is an example of a locked state where connection of the ink supply part 34 to the connection part 107 is maintained against the biasing force of the coil springs 78, 98, and 115.

The operation part 90 is provided on the outer surface of the first upper wall 39A at a position forward of the lock surface 62. When an operation surface 92 of the operation part 90 is pushed downward in a state where the ink cartridge 30 is attached to the cartridge attachment section 110, the ink cartridge 30 is pivotally moved to shift the lock surface 62 to a position below the locking part 129. This allows the ink cartridge 30 to be removed from the cartridge attachment section 110. The state where the lock surface 62 is separated away from the locking part 129 is an example of a released state, at which the ink cartridge 30 can be moved forward.

The light shielding plate 67 is provided on the outer surface of the first upper wall 39A at a position rearward of the convex part 43. The light shielding plate 67 protrudes upward from the outer surface of the first upper wall 39A and extends in the front-rear direction 8. More specifically, the light shielding plate 67 is desirably provided at the first base part 48 of the casing 31. The light shielding plate 67 shields light outputted from the light emitting part of the attachment sensor 113. One or more cutouts 66 is formed in the light shielding plate 67. Each cutout 66 is a space recessed downward from the upper end of the light shielding plate 67 and extends in the front-rear direction 8. When a cutout 66 of the light shielding plate 67 is disposed in the optical path of the light outputted from the attachment sensor 113, the light is not shielded by the light shielding plate 67, but reaches the light receiving part.

That is, in the process of attachment of the ink cartridge 30 to the cartridge attachment section 110, a high level signal of a pattern corresponding to the positions, sizes, and the number of the cutouts 66 formed in the light shielding plate 67 is outputted to the control board. Accordingly, the control board can identify the type of the ink cartridge 30 (ink color, initial storage amount, and the like) based on the pattern of the signal outputted from the attachment sensor 113. The light shielding plate 67 is an example of an information holding portion that retains information indicating the type of the ink cartridge 30.

The IC substrate 64 is provided on the outer surface of the first upper wall 39A at a position between the light shielding plate 67 and the convex part 43 in the front-rear direction 8. More specifically, the IC substrate 64 is desirably provided at the first base part 48 of the casing 31. The IC substrate 64 has an IC (not illustrated) and electrodes 65. The IC stores information concerning the ink cartridge 30, such as a lot number, a manufacturing date, an ink color, and the like in such a manner that the information is readable from the IC. Each electrode 65 is electrically connected to the IC. The electrodes 65 are exposed on the upper surface of the IC substrate 64 so as to be electrically accessible.

In a state where the ink cartridge 30 is attached to the cartridge attachment section 110, each electrode 65 is electrically conducted to the corresponding contact 106. This allows the control board to access data stored in the IC through the contacts 106. The IC substrate 64 is an example of an information holding portion that holds information indicating the type of the ink cartridge 30.

As illustrated in FIG. 8, in the inner space of the casing 31, there are formed the upper storage chamber 32, the lower storage chamber 33, an ink valve chamber 35, and an air valve chamber 36. The upper storage chamber 32, lower storage chamber 33, and ink valve chamber 35 store ink. The upper storage chamber 32 and lower storage chamber 33 are an example of a first storage chamber. The air valve chamber 36 communicates air between the upper storage chamber 32 and the outside of the casing 31.

The upper storage chamber 32 and the lower storage chamber 33 are disposed adjacent to each other in the up-down direction 7, with a partition wall 45 partitioning the inner space of the casing 31 being interposed between the upper storage chamber 32 and the lower storage chamber 33. Further, the upper storage chamber 32 and lower storage chamber 33 communicate with each other through an unillustrated through-hole 47 (an example of a communication passage) formed in the partition wall 45. The through-hole 47 is desirably formed at a position forward of the third rear wall 40C in the front-rear direction 8. The capacity of the upper storage chamber 32 is greater than the capacity of the lower storage chamber 33. The capacity of the upper storage chamber 32 is greater than the total capacity of the lower storage chamber 33 and ink valve chamber 35. The upper storage chamber 32 extends over the insides of both of the first base part 48 and the first protruding part 49 of the casing 31. Accordingly, the horizontal cross sectional area of a part of the upper storage chamber 32 that is disposed above the first lower wall 42A is larger than the horizontal cross sectional areas of: a part of the upper storage chamber 32 that is disposed below the first lower wall 42A; the lower storage chamber 33; and the ink valve chamber 35.

The upper storage chamber 32 and the air valve chamber 36 are disposed adjacent to each other in the up-down direction 7, with a partition wall 44 partitioning the inner space of the casing 31 being interposed between the upper storage chamber 32 and the air valve chamber 36. Further, the upper storage chamber 32 and air valve chamber 36 communicate with each other through a through-hole 46 formed in the partition wall 44. The lower storage chamber 33 is positioned forward of the ink valve chamber 35 in the front-rear direction 8. The lower storage chamber 33 and ink valve chamber 35 communicate with each other through a through-hole 99. The capacity of the lower storage chamber 33 is smaller than the capacity of the storage chamber 121 of the tank 103. The total capacity of the lower storage chamber 33 and ink valve chamber 35 is smaller than the capacity of the storage chamber 121 of the tank 103.

The air valve chamber 36 is an air flow path provided above the upper storage chamber 32. More specifically, the air valve chamber 36 is desirably provided above the upper end of the first protruding part 49. Further, the second rear wall 40B is desirably positioned rearward of the air communication port 96 that is formed in the first rear wall 40A to communicate the inside of the air valve chamber 36 with the outside of the casing 31. As shown in FIG. 8, a semipermeable membrane 95 is provided in the air valve chamber 36. An unillustrated labyrinth passage 97 may be provided in place of the semipermeable membrane 95 in the air valve chamber 36. However, the semipermeable membrane 95 or the unillustrated labyrinth passage 97 may not be provided in the air valve chamber 36. A valve 97 and the coil spring 98 are housed in the air valve chamber 36. The valve 97 is movable between a closed position (an example of a first state), at which the valve 97 closes the air communication port 96, and an open position (an example of a second state), at which the valve 97 opens the air communication port 96. The coil spring 98 biases the valve 97 in the backward direction to move the valve 97 to the closed position.

In the process of attachment of the ink cartridge 30 to the cartridge attachment section 110, the rod 125 enters the air valve chamber 36 through the air communication port 96. The rod 125 having entered the air valve chamber 36 moves the valve 97 at the closed position in a forward direction against the biasing force of the coil spring 98. When the valve 97 is moved to the open position, the upper storage chamber 32 is opened to the atmosphere. The configuration for opening the air communication port 96 is not limited to the above-described example. For example, a configuration may be adopted in which a film sealing the air communication port 96 is broken by the rod 125.

The ink supply part 34 protrudes rearward from the third rear wall 40C. More specifically, the ink supply part 34 is desirably provided on a surface of the first base part 48 that faces backward and at a position below the lower end of the first protruding part 49. The ink supply part 34 is a cylindrical member (an example of a first cylindrical part). The inner space of the ink supply part 34 serves as the ink valve chamber 35. The protruding end (tip end) of the ink supply part 34 is opened to the outside of the ink cartridge 30. The second rear wall 40B is positioned rearward of the protruding end (tip end) of the ink supply part 34. In the ink valve chamber 35, a seal member 76, a valve 77, and a coil spring 78 are housed.

The seal member 76 is a disk-shaped member in which a through-hole is formed at the center thereof. The seal member 76 is formed of an elastic material such as rubber or elastomer. An ink supply port 71 is formed at the center of the seal member 76 so as to penetrate therethrough in the front-rear direction 8. The inner diameter of the ink supply port 71 is slightly smaller than the outer diameter of the ink needle 102. In the ink valve chamber 35, the valve 77 is configured to move in the front-rear direction 8 between a closed position, at which the valve 77 abuts against the seal member 76 to close the ink supply port 71, and an open position, at which the valve 77 is apart from the seal member 76 to open the ink supply port 71. The coil spring 78 biases the valve 77 in the rearward direction to move the valve 77 to the closed position.

In the process of insertion of the ink cartridge 30 to the cartridge attachment section 110, the ink needle 102 enters the ink valve chamber 35 through the ink supply port 71. At this time, the ink needle 102 liquid-tightly contacts the inner peripheral surface of the seal member 76 that defines the ink supply port 71, while elastically deforming the seal member 76. When the ink cartridge 30 is inserted further into the cartridge attachment section 110, the ink needle 102 moves the valve 77 to its open position against the biasing force of the coil spring 78. Simultaneously, the valve 77 moves the valve 114, which is protruding from the opening 116 of the ink needle 102, to its open position against the biasing force of the coil spring 115.

As a result, as illustrated in FIG. 9, both of the ink supply port 71 and the opening 116 are opened to allow ink to flow between the inner space of the ink valve chamber 35 of the ink supply part 34 and the inner space of the ink needle 102. This state is an example of a state where the ink supply part 34 and the connection part 107 are connected to each other. As a result, due to the water head difference, ink flows out of the upper storage chamber 32 and lower storage chamber 33 to the storage chamber 121 of the tank 103 through the ink supply part 34 and connection part 107 that are connected with each other.

As illustrated in FIG. 9, in the state where the ink cartridge 30 is attached to the cartridge attachment section 110, that is, in the state where the ink supply part 34 is connected to the connection part 107, the first base part 48 and first protruding part 49 of the ink cartridge 30 and the second base part 118 and second protruding part 119 of the tank 103 have the following positional relationship:

As viewed in the front-rear direction 8, the first base part 48 is overlapped with both of the second base part 118 and the second protruding part 119. As viewed in the up-down direction 7, the first base part 48 is not overlapped with the second base part 118, and is not overlapped with the second protruding part 119. In other words, as viewed in the up-down direction 7, neither the second base part 118 nor the second protruding part 119 is overlapped with the first base part 48. More specifically, in the state where the ink cartridge 30 is attached to the cartridge attachment section 110, the third rear wall 40C is disposed forward of the second front wall 152B.

In addition, as viewed in the front-rear direction 8, the first protruding part 49 is overlapped with the second base part 118, but is not overlapped with the second protruding part 119. In other words, in the state where the ink cartridge 30 is attached to the cartridge attachment section 110, the second upper wall 39B is disposed below the first upper wall 151A, and the first lower wall 42A is disposed above the second upper wall 151B.

Further, as viewed in the up-down direction 7, the first protruding part 49 is not overlapped with the second base part 118, but is overlapped with the second protruding part 119. In other words, in the state where the ink cartridge 30 is attached to the cartridge attachment section 110, the second rear wall 40B is disposed rearward of the second front wall 152B. More specifically, in the state where the ink cartridge 30 is attached to the cartridge attachment section 110, part of the upper storage chamber 32 disposed inside the first protruding part 49 and part of the storage chamber 121 disposed inside the second protruding part 119 are desirably overlapped with each other as viewed in the up-down direction 7.

In the present specification, the expression "the first protruding part 49 is overlapped with the second protruding part 119" is intended to mean that at least a part of the first protruding part 49 and at least a part of the second protruding part 119 are overlapped with each other. That is, the expression "the first protruding part 49 is overlapped with the second protruding part 119" includes: a state where the entire first protruding part 49 and entire second protruding part 119 are overlapped with each other; a state where the entire first protruding part 49 and a part of the second protruding part 119 are overlapped with each other; a state where a part of the first protruding part 49 and the entire second protruding part 119 are overlapped with each other; and a state where a part of the first protruding part 49 and a part of the second protruding part 119 are overlapped with each other. The same can be applied to the expressions "the first protruding part 49 is overlapped with the second base part 118", "the first base part 48 is overlapped with the second base part 118", and "the first base part 48 is overlapped with the second protruding part 119".

According to the above-described embodiment, the first protruding part 49 of the ink cartridge 30 is disposed in the space obtained by recessing the cartridge attachment section 110 (that is, the space surrounded by the first front wall 152A and second upper wall 151B), and the second protruding part 119 of the tank 103 is disposed in the space obtained by recessing the ink cartridge 30 (that is, the space surrounded by the first lower wall 42 and third rear wall 40C). Thus, the ink cartridge 30 and cartridge attachment section 110 can be adequately laid out without involving an increase in the size of the multifunction peripheral 10. In particular, arranging a part of the upper storage chamber 32 that is disposed in the first protruding part 49 and a part of the storage chamber 121 that is disposed in the second protruding part 119 at such positions that the part of the upper storage chamber 32 and the part of the storage chamber 121 are overlapped with each other as viewed in the up-down direction 7, allows the sizes of the upper storage chamber 32 and storage chamber 121 to be increased without increasing the size of the multifunction peripheral 10.

Further, according to the above-described embodiment, the first protruding part 49 is provided at the upper part of the ink cartridge 30 in the up-down direction 7, and the second protruding part 119 is provided at the lower part of the cartridge attachment section 110 in the up-down direction 7. Accordingly, as described below, image recording can be continued even after cartridge empty, and also the amount of ink that will flow out of the ink cartridge 30 at the time of attachment of the ink cartridge 30 to the cartridge attachment section 110 can be suppressed.

First, the horizontal cross sectional area of a part of the storage chamber 121 at the lower portion of the cartridge attachment section 110 where the second protruding part 119 is formed, can be made greater than the horizontal cross sectional areas of: a part of the storage chamber 121 that is disposed above the second protruding part 119; the buffer chamber 122; and the flow path 123. That is, the capacity of the lower part of the storage chamber 121 where residual ink is supposed to remain until ink is completely consumed can be made relatively larger, so that a time period during which image recording can be continuously performed after cartridge empty can be prolonged.

Among: the part of the storage chamber 121 disposed above the second protruding part 119; buffer chamber 122; and flow path 123, only a part of the tank 103 in which ink can enter at the use posture of the multifunction peripheral 10, may have a horizontal cross sectional area smaller than that of a part of the storage chamber 121 disposed below the upper end of the second protruding part 119. In other words, such part of the tank 103 in which ink cannot enter (the upper region of the buffer chamber 122, for example) may have a horizontal cross sectional area greater than the horizontal cross sectional area of a part of the storage chamber 121 that is disposed below the upper end of the second protruding part 119. The "part of the tank 103 in which ink can enter" refers to, for example, a part of the tank 103 that is positioned below the liquid surface of ink of a maximum amount that is stored in an ink cartridge 30 at a timing immediately after the ink cartridge 30 is newly attached to the cartridge attachment section 110 and before ink starts flowing out of the ink cartridge 30 to the tank 103.

Further, the capacities of: a part of the storage chamber 121 disposed above the second protruding part 119; the buffer chamber 122; and the flow path 123 can be made relatively small. This can shorten the length of time required after an ink cartridge 30 is newly attached to the cartridge attachment section 110 and until the liquid surfaces of ink in the upper storage chamber 32 and in the tank 103 (storage chamber 121, buffer chamber 122, and flow path 123) become equal to each other in their heights. Thus, the amount of ink that is to flow from the ink cartridge 30 to the tank 103 when the ink cartridge 30 is newly attached to the cartridge attachment section 110 can be reduced. Further, the horizontal cross sectional area of a part of the upper storage chamber 32 that is disposed at the upper portion of the ink cartridge 30, where the first protruding part 49 is provided, can be made larger than the horizontal cross sectional areas of: a part of the upper storage chamber 32 disposed below the first protruding part 49; the lower storage chamber 33; and ink valve chamber 35. Thus, the ink cartridge 30 having the first protruding part 49 can suppress the amount, by which the level of the liquid surface of ink in the ink cartridge 30 lowers when the ink cartridge 30 is newly attached to the cartridge attachment section 110, as compared to such an ink cartridge having no first protruding part 49.

Further, according to the above-described embodiment, the ink supply part 34 is provided below the first protruding part 49. Accordingly, the amount of ink that does not flow out of the ink supply part 34 and remains in the lower storage chamber 33 and ink valve chamber 35 can be reduced. Further, the through-hole 47, through which the upper storage chamber 32 is communicated with the lower storage chamber 33, is provided at a position on the front part of the partition wall 45. This reduces the amount of ink that flows out of the ink supply part 34 when the ink cartridge 30 is oriented so that the ink supply port 71 faces downward. Thus, for example, even when the ink cartridge 30 is erroneously inclined by a user, the amount of ink to leak from the ink cartridge 30 can be reduced.

Further, according to the above-described embodiment, the ink supply part 34 is provided at the first base part 48, and the air communication port 96, in which the rod 125 enters, is provided above the first protruding part 49. Accordingly, a plurality of types of ink cartridges 30, which are different in the protruding amounts of the first protruding parts 49 and therefore which are different in the capacities of the upper storage chambers 32, can be selectively attached to the cartridge attachment section 110.

Further, in the above-described embodiment, the pivot member 50 for detecting the residual amount of ink is disposed inside the storage chamber 121, so that the configuration of the ink cartridge 30 can be made simple. As a result, a degree of freedom in design of the outer shape of the ink cartridge 30 is increased. Further, when the liquid surface of ink in the storage chamber 121 lowers to a position below the boundary position P1, the detection signal outputted from the liquid surface sensor 55 changes. This boundary position P1 is set below the upper end of the second protruding part 119 and above the second communication port 128. Accordingly, the liquid surface sensor 55 can adequately detect whether the ink residual amount in the storage chamber 121 has become small. However, the pivot member 50 may be disposed inside the ink cartridge 30.

Figure 10:
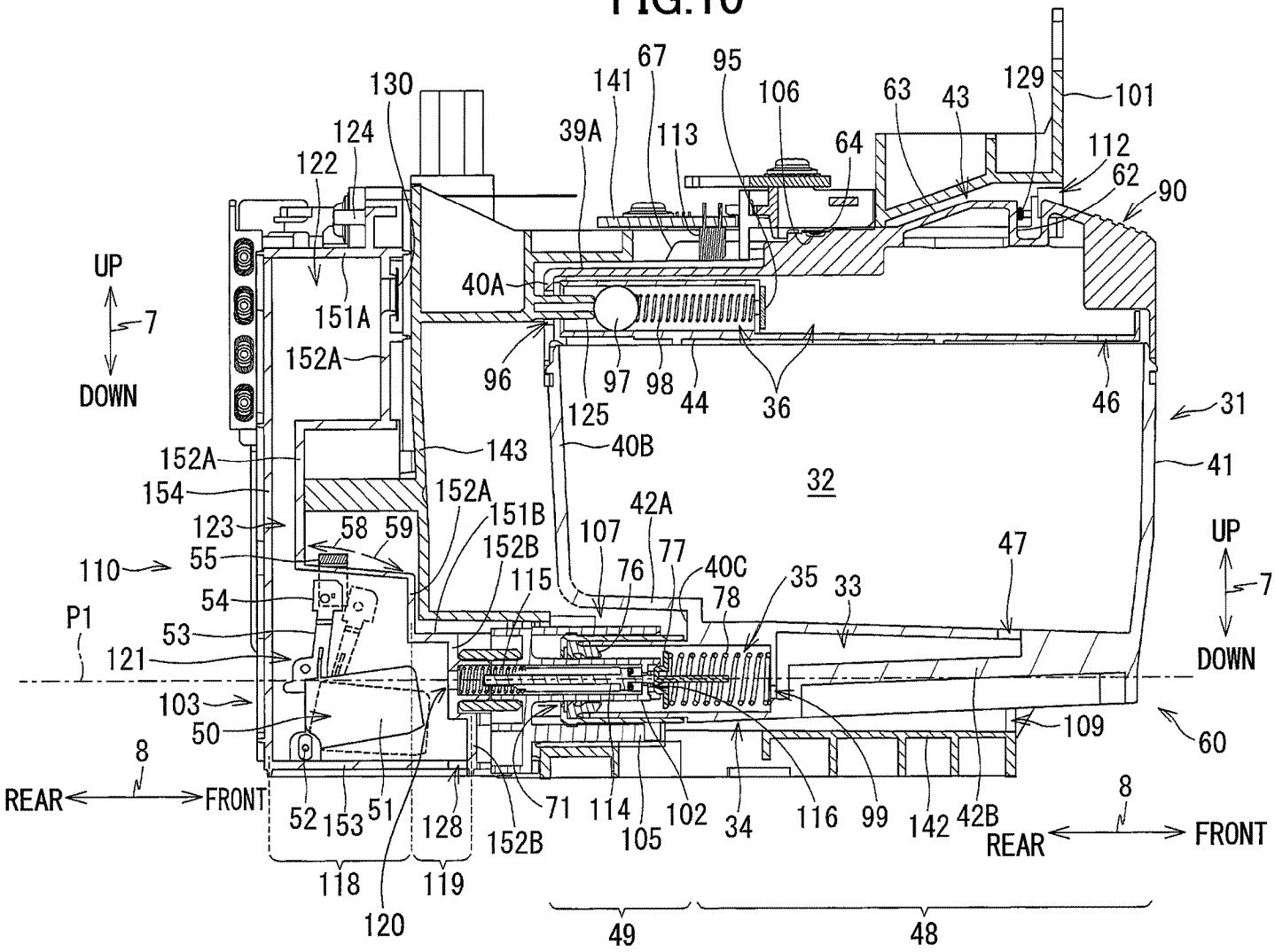
FIG. 10 is a vertical cross-sectional view of the cartridge attachment section 110, in which another ink cartridge 60 is attached.

As illustrated in FIG. 10, an ink cartridge 60 can be attached to the cartridge attachment section 110 in place of the above-described ink cartridge 30. That is, the ink supply parts 34 of the ink cartridges 30 and 60 that store the ink of the same color can be detachably connected with the connection part 107. The ink cartridges 30 and 60 have the same lengths in each of the up-down direction 7 and left-right direction 9. Further, in the ink cartridges 30 and 60, the distances between the lock surface 62 and other components (for example, ink supply port 71, air communication port 96, IC substrate 64, and light shielding plate 67) in the up-down direction 7 and front-rear direction 8 are the same. The ink cartridge 30 is an example of a first ink cartridge, and the ink cartridge 60 is an example of a second ink cartridge.

As compared to the ink cartridge 30, the ink cartridge 60 is smaller in the protruding amount of the first protruding part 49. That is, in a state where the ink cartridge 60 is attached to the cartridge attachment section 110, the first protruding part 49 of the ink cartridge 60 may be disposed at such a position that the first protruding part 49 of the ink cartridge 60 is not overlapped with the second protruding part 119 as viewed in the up-down direction 7. Further, as compared to the ink cartridge 30, the ink cartridge 60 is smaller in the capacity of the upper storage chamber 32. More specifically, in the ink cartridge 60 illustrated in FIG. 10, the second upper wall 39B is omitted, and the first rear wall 40A and second rear wall 40B are in flush with each other. In the ink cartridge 60, the protruding amount of the first protruding part 49 may be zero (0). That is, the ink cartridge 60 may not have the first protruding part 49, but may have the first base part 48 only. In other words, the first lower wall 42A may be omitted, and the first rear wall 40A, the second rear wall 40B and third rear wall 40C may be in flush with each other.

According to the above-described embodiment, by increasing or reducing the protruding amount of the first protruding part 49 and changing the capacity of the part of the upper storage chamber 32 disposed inside the first protruding part 49, the ink cartridges 30 and 60 having different capacities and different outer shapes can selectively be attached to the cartridge attachment section 110 without increasing the size of the multifunction peripheral 10 in the front-rear direction. In particular, by disposing the part of the upper storage chamber 32 inside the first protruding part 49 and the part of the storage chamber 121 inside the second protruding part 119 so as to be overlapped with each other as viewed in the up-down direction 7, the sizes of the upper storage chamber 32 and lower storage chamber 121 can be increased without involving an increase in the size of the multifunction peripheral 10.

Further, according to the above-described embodiment, by setting the sizes of the ink cartridges 30 and 60 to be the same with each other in each of the up-down direction 7 and left-right direction 9, a desired one of the ink cartridges 30 and 60 that store ink of the same color can be selectively connected to a corresponding connection part 107 provided in the cartridge attachment section 110 that is configured to receive four ink cartridges 30 for four different colors at the same time.

Further, according to the above-described embodiment, those components (for example, ink supply part 34, convex part 43, IC substrate 64, light shielding plate 67, operation part 90, and air communication port 96), each of which should be disposed at the same position among all the ink cartridges 30 and 60, are disposed at the first base part 48. This allows the plurality of types of the ink cartridges 30 and 60 having the first protruding parts 49 with different protruding amounts to be selectively attached to the cartridge attachment section 110.

Further, according to the above-described embodiment, the ink supply part 34 is disposed below the first protruding part 49. Thus, in such a type of multifunction peripheral 10, in which ink is supplied from the ink cartridge 30 to the tank 103 due to the water head difference, most of the ink stored in the ink cartridge 30 can be supplied to the storage chamber 121 so as to be consumed by the recording head 21.

In the above-described embodiment, the air communication port 96 is opened and closed by the valve 97; however, the concrete configuration for communicating the inside of the upper storage chamber 32 of the ink cartridge 30 or 60 with the atmosphere is not limited to the above-described configuration. For example, the valve 97 and coil spring 98 may be omitted from the air valve chamber 36 so that the semipermeable membrane 95 provided in the air valve chamber 36 always communicates the inside of the air valve chamber 36 with the atmosphere. This configuration eliminates the need to have a component (for example, the rod 125) of the cartridge attachment section 110 abut against the ink cartridge 30 or 60 to open the air communication port 96 at a position above the liquid surface of ink stored in the ink cartridge 30 or 60. As a result, a degree of freedom in design of the outer shapes of the respective ink cartridges 30 and 60 is increased.

Further, in the above-described embodiment, the ink cartridge 30 or 60 is inserted into and removed from the cartridge attachment section 110 in the front-rear direction 8. However, the insertion/removal direction of the ink cartridge 30 or 60 is not limited to the front-rear direction 8, but may be the up-down direction 7 or left-right direction 9. Further, ink may be supplied from the ink cartridge 30 or 60 to the tank 103 not only due to the water head difference, but also by using a pump.

Figure 11A:
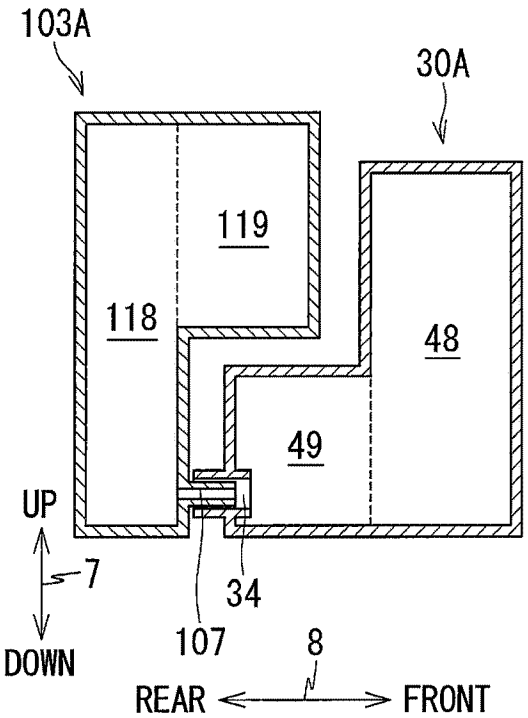
Figure 11B:
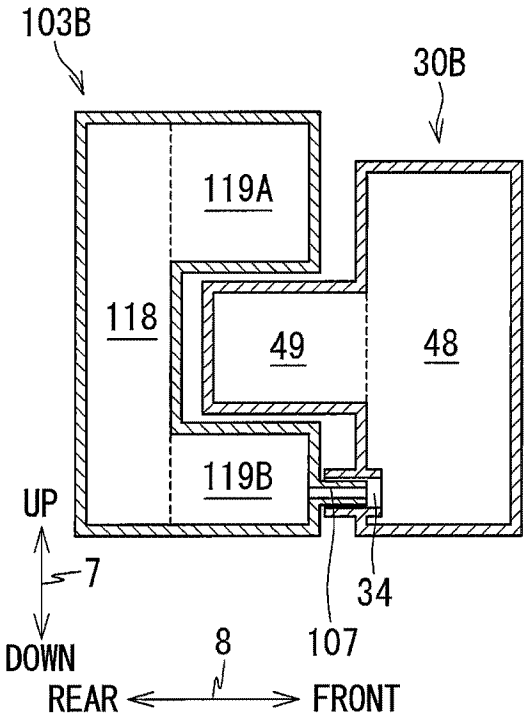
Figure 11C:
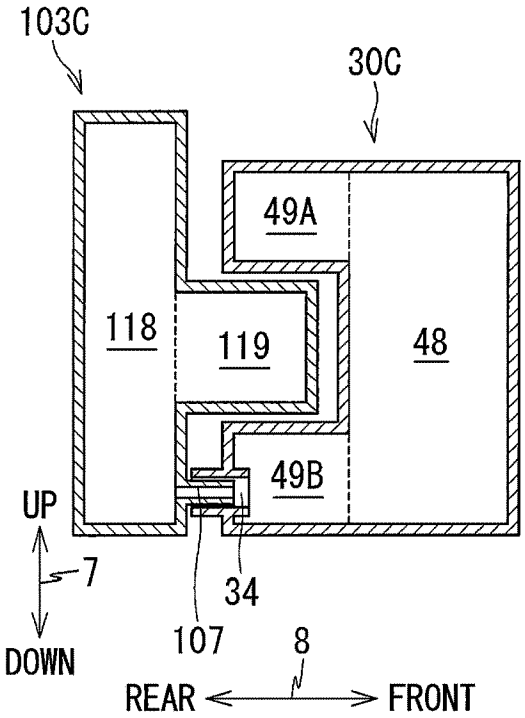

The positional relationship between: the first base part 48 and the first protruding part 49 of each of the ink cartridges 30 and 60; and the second base part 118 and the second protruding part 119 of the tank 103 is not limited to the above-described example. With reference to FIGS. 11A-11C, next will be described other various examples of the layout of the first base part 48, first protruding part 49, second base part 118, second protruding part 119, ink supply part 34, and connection part 107 in a state where the ink cartridge 30 is attached to the cartridge attachment section 110.

It is noted that in all of these examples shown in FIGS. 11A-11C, whether the first base part 48 and first protruding part 49 are overlapped with the second base part 118 and the second protruding part 119 as viewed in the up-down direction 7 and front-rear direction 8 is the same as that in the above-described embodiment. In FIGS. 11A to 11C, the positional relationship among the first base part 48, first protruding part 49, second base part 118, second protruding part 119, ink supply part 34, and connection part 107 is mainly illustrated, and illustrations of other components are omitted.

As a first example, an ink cartridge 30A illustrated in FIG. 11A has the first base part 48 and the first protruding part 49 protruding rearward from the lower portion of the first base part 48. The ink supply part 34 protrudes from a surface of the first protruding part 49 that faces rearward. A tank 103A illustrated in FIG. 11A has the second base part 118 and the second protruding part 119 protruding forward from the upper portion of the second base part 118. The connection part 107 protrudes from a surface of the second base part 118 that faces forward. By reducing the protruding amount of a part of the first protruding part 49 that is positioned above the ink supply part 34, a second cartridge that can be attached to the cartridge attachment section 110 in place of the ink cartridge 30A (an example of a first cartridge) can be obtained.

As another example, an ink cartridge 30B illustrated in FIG. 11B has the first base part 48 and the first protruding part 49 protruding rearward from the center portion of the first base part 48 in the up-down direction 7. The ink supply part 34 is disposed below the first protruding part 49 and protrudes from a surface of the first base part 48 that faces rearward. A tank 103B illustrated in FIG. 11B has the second base part 118 and second protruding parts 119A and 119B that protrude forward from two portions (upper and lower portions) of the second base part 118. The connection part 107 protrudes from a surface of the lower-side second protruding part 119B that faces forward.

As yet another example, an ink cartridge 30C illustrated in FIG. 11C has the first base part 48 and first protruding parts 49A and 49B that protrude rearward from the two portions (upper and lower portions) of the first base part 48. The ink supply part 34 protrudes from a surface of the lower-side first protruding part 49B that faces rearward. A tank 103C illustrated in FIG. 11C has the second base part 118 and the second protruding part 119 protruding forward from the center portion of the second base part 118 in the up-down direction 7. The connection part 107 is disposed below the second protruding part 119 and protrudes from a surface of the second base part 118 that faces forward. By reducing the protruding amount of the upper-side first protruding part 49A, a second cartridge that can be attached to the cartridge attachment section 110 in place of the ink cartridge 30C (an example of the first cartridge) can be obtained.

The liquid stored in the ink cartridges 30 and 60 and tank 103 is not limited to ink. For example, pretreatment liquid, which is for being ejected onto a recording sheet before ink is ejected onto the recording sheet to print images, or water for cleaning the recording head 21 may be stored in the ink cartridges 30 and 60 and tank 103.

While the description has been made in detail with reference to specific embodiment thereof, it would be apparent to those skilled in the art that various changes and modifications may be made therein without departing from the spirit and scope of the above described aspects.

What is claimed is:

1. A liquid consumption apparatus comprising: a cartridge; a cartridge attachment section; and a consuming device, the cartridge comprising:

a first storage chamber storing a liquid;

a first air communication portion allowing the first storage chamber to communicate with an atmosphere; and a supply portion configured to supply the liquid stored in the first storage chamber, the cartridge attachment section comprising:

a connecting portion configured to be connected with and disconnected from the supply portion; and a tank, the tank comprising:

a liquid flow-in port allowing the liquid, which has been supplied from the first storage chamber through the supply portion and the connecting portion connected with the supply portion, to pass though the liquid flow-in port;

a second storage chamber configured to store the liquid that has flown through the liquid flow-in port;

a liquid flow-out port disposed at a position below the liquid flow-in port and configured to allow the liquid stored in the second storage chamber to flow out of the second storage chamber; and a second air communication portion allowing the second storage chamber to communicate with the atmosphere, the consuming device being configured to consume the liquid flown from the second storage chamber through the liquid flow-out port;

the cartridge further comprising a wall defining a first base part and a first protruding part, the first storage chamber extending over insides of both of the first base part and the first protruding part, the tank further comprising a wall defining a second base part and a second protruding part, the second storage chamber extending over insides of both of the second base part and the second protruding part, in a used posture of the liquid consumption apparatus, the first protruding part protruding in a horizontal direction from an upper portion of the first base part that is defined in a vertical direction, and the second protruding part protruding in the horizontal direction from a lower portion of the second base part that is defined in the vertical direction, in a state where the supply portion is connected to the connecting portion, the first base part and the first protruding part having the following positional relationship with the second base part and the second protruding part:

as viewed in the horizontal direction, the first base part is overlapped with both of the second base part and the second protruding part;

as viewed in the vertical direction, the first base part is not overlapped with the second base part, and is not overlapped with the second protruding part;

as viewed in the horizontal direction, the first protruding part is overlapped with the second base part, but is not overlapped with the second protruding part; and as viewed in the vertical direction, the first protruding part is overlapped with the second protruding part, but is not overlapped with the second base part.

2. The liquid consumption apparatus according to claim 1, wherein the supply portion and the connecting portion are connected together in a case where the cartridge is inserted into the cartridge attachment section in an inserting direction that is parallel to the horizontal direction, wherein the supply portion and the connecting portion are separated from each other in a case where the cartridge is detached from the cartridge attachment section in a detaching direction that is opposite to the inserting direction, wherein the first protruding part has a surface facing in the inserting direction, the supply portion being provided at the surface of the first base part at a position below a lower end of the first protruding part, and wherein the second protruding part has a surface facing in the detaching direction, the connecting portion being provided at the surface of the second protruding part.

3. The liquid consumption apparatus according to claim 2, wherein the first protruding part has a tip end in the inserting direction that is positioned downstream of the supply portion in the inserting direction.

4. The liquid consumption apparatus according to claim 2, wherein the cartridge further comprises a partition wall partitioning the first storage chamber into an upper storage chamber and a lower storage chamber such that the upper storage chamber and the lower storage chamber are arranged adjacent to each other in the vertical direction with the partition wall being interposed therebetween, wherein the partition wall has a communication passage disposed at a position upstream of the first protruding part in the inserting direction and allowing communication between the upper storage chamber and the lower storage chamber, and wherein the supply portion is communicated with the lower storage chamber.

5. The liquid consumption apparatus according to claim 4, wherein the upper storage chamber has an internal volume greater than that of the lower storage chamber.

6. The liquid consumption apparatus according to claim 4, wherein the second storage chamber has a partial internal volume defined below an upper end of the second protruding part, the partial internal volume being greater than the internal volume of the lower storage chamber.

7. The liquid consumption apparatus according to claim 1, wherein the supply portion and the connecting portion are connected together in a case where the cartridge is inserted into the cartridge attachment section in an inserting direction that is parallel to the horizontal direction, wherein the supply portion and the connecting portion are separated from each other in a case where the cartridge is detached from the cartridge attachment section in a detaching direction that is opposite to the inserting direction, wherein the supply portion comprises a first cylindrical portion extending in the inserting direction and being opened at a downstream tip end in the inserting direction;

wherein the connecting portion comprises a second cylindrical portion extending in the detaching direction and being opened at a downstream tip end in the detaching direction, the supply portion being connected to the connecting portion by inserting one of the first cylindrical portion and the second cylindrical portion into remaining one of the first cylindrical portion and the second cylindrical portion.

8. The liquid consumption apparatus according to claim 1, wherein the supply portion and the connecting portion are connected together in a case where the cartridge is inserted into the cartridge attachment section in an inserting direction that is parallel to the horizontal direction, wherein the supply portion and the connecting portion are separated from each other in a case where the cartridge is detached from the cartridge attachment section in a detaching direction that is opposite to the inserting direction, wherein the wall of the cartridge has a surface facing in the inserting direction, wherein the first air communication portion comprises:

an air passage; and a valve selectively providing a first state closing the air passage and an open state opening the air passage, the air passage having one end opened on the surface of the wall at a position above an upper end of the first protruding part to thereby define an opening of the air passage, the air passage having another end in communication with the first storage chamber, and wherein the cartridge attachment section further comprises a rod configured to enter into the opening of the air passage to change the state of the valve from the first state to the second state when the supply portion is connected to the connecting portion.

9. The liquid consumption apparatus according to claim 8, wherein the first protruding part has a tip end that is positioned downstream of the opening of the air passage in the inserting direction.

10. The liquid consumption apparatus according to claim 1, wherein the cartridge attachment section further comprises a detector configured to detect an amount of liquid stored in the second storage chamber.

11. The liquid consumption apparatus according to claim 10, wherein the detector comprises:

a detected portion disposed in the second storage chamber and configured to move to a position corresponding to an amount of the liquid stored in the second storage chamber; and a sensor configured to detect, on a basis of a position of the detected portion, whether a level of the liquid is higher than a boundary position that is defined below an upper end of the second protruding part and above the liquid flow-out port.

12. The liquid consumption apparatus according to claim 1, wherein in the state where the supply portion is connected with the connecting portion, part of the first storage chamber disposed inside the first protruding part is overlapped with part of the second storage chamber disposed inside the second protruding part as viewed in the vertical direction.

13. The liquid consumption apparatus according to claim 1, wherein the cartridge further comprises an information holding portion disposed at the first base part and holding information indicative of a type of the cartridge; and wherein the cartridge attachment section further comprises a reading device configured to read the information held in the information holding portion.

14. The liquid consumption apparatus according to claim 1, wherein the cartridge attachment section further comprises a locking portion configured to switch the cartridge between a locked state, in which connection of the supply portion with the connecting portion is maintained, and a released state, in which the cartridge is movable relative to the cartridge attachment section, and wherein the locking portion brings the cartridge into the locked state when the first base part of the cartridge abuts against the locking portion, and the locking portion brings the cartridge into the released state when the first base part of the cartridge becomes separated away from the locking portion.

15. The liquid consumption apparatus according to claim 1, wherein the first air communication portion comprises:

a first air passage providing communication between an inside of the first storage chamber and an outside of the cartridge; and a semipermeable membrane provided in the first air passage.

16. The liquid consumption apparatus according to claim 1, wherein the second air communication portion comprises:

a second air passage providing communication between an inside of the second storage chamber and an outside of the tank; and a semipermeable membrane provided in the second air passage.

17. The liquid consumption apparatus according to claim 1, wherein the liquid stored in the first storage chamber is an ink; and wherein the consuming device comprises a recording head having a nozzle configured to eject the ink flowing into the second storage chamber from the first storage chamber to form an image on an image recording medium.

18. A liquid consumption system comprising: a cartridge; and a liquid consumption apparatus, the cartridge comprising:

a first storage chamber storing a liquid;

a first air communication portion allowing the first storage chamber to communicate with an atmosphere; and a supply portion configured to supply the liquid stored in the first storage chamber, the liquid consumption apparatus being configured to consume the liquid supplied from the supply portion of the cartridge, the liquid consumption apparatus comprising:

a cartridge attachment section; and a consuming section, the cartridge attachment section comprising:

a connecting portion configured to be connected with and disconnected from the supply portion; and a tank, the tank comprising:

a liquid flow-in port allowing the liquid, which has been supplied from the first storage chamber through the supply portion and the connecting portion connected with the supply portion, to pass though the liquid flow-in port;

a second storage chamber configured to store the liquid that has flown through the liquid flow-in port;

a liquid flow-out port disposed at a position below the liquid flow-in port and configured to allow the liquid stored in the second storage chamber to flow out of the second storage chamber; and a second air communication portion allowing the second storage chamber to communicate with the atmosphere, the consuming section being configured to consume the liquid flown from the second storage chamber through the liquid flow-out port;

the cartridge further comprising a wall defining a first base part and a first protruding part, the first storage chamber extending over insides of both of the first base part and the first protruding part, the tank further comprising a wall defining a second base part and a second protruding part, the second storage chamber extending over insides of both of the second base part and the second protruding part, in a used posture of the liquid consumption apparatus, the first protruding part protruding in a horizontal direction from an upper portion of the first base part that is defined in a vertical direction, and the second protruding part protruding in the horizontal direction from a lower portion of the second base part that is defined in the vertical direction, in a state where the supply portion is connected to the connecting portion, the first base part and the first protruding part having the following positional relationship with the second base part and the second protruding part:

as viewed in the horizontal direction, the first base part is overlapped with both of the second base part and the second protruding part;

as viewed in the vertical direction, the first base part is not overlapped with the second base part, and is not overlapped with the second protruding part;

as viewed in the horizontal direction, the first protruding part is overlapped with the second base part, but is not overlapped with the second protruding part; and as viewed in the vertical direction, the first protruding part is overlapped with the second protruding part, but is not overlapped with the second base part.

* * * * *